US008777584B2

(12) United States Patent
Mehr

(10) Patent No.: US 8,777,584 B2
(45) Date of Patent: Jul. 15, 2014

(54) ENERGY SAVING GREEN WASTEWATER PUMP STATION DESIGN

(76) Inventor: Nasser Fred Mehr, Fort Lauderdale, FL (US)

( * ) Notice: Subject to any disclaimer, the term of this patent is extended or adjusted under 35 U.S.C. 154(b) by 257 days.

(21) Appl. No.: 13/335,908

(22) Filed: Dec. 22, 2011

(65) Prior Publication Data

US 2013/0164149 A1 Jun. 27, 2013

(51) Int. Cl.
*F04B 49/04* (2006.01)
*F04B 41/06* (2006.01)

(52) U.S. Cl.
USPC ..... 417/8; 417/41; 417/12; 417/53

(58) Field of Classification Search
USPC ..... 417/36, 40, 41, 53, 5, 7, 8, 12
See application file for complete search history.

(56) References Cited

U.S. PATENT DOCUMENTS

| | | | | |
|---|---|---|---|---|
| 3,630,637 | A * | 12/1971 | Repp | 417/7 |
| 4,341,983 | A * | 7/1982 | Gottliebson | 318/102 |
| 5,190,442 | A * | 3/1993 | Jorritsma | 417/7 |
| 5,591,010 | A * | 1/1997 | Van Zyl | 417/12 |
| 6,186,743 | B1 * | 2/2001 | Romer | 417/3 |

* cited by examiner

*Primary Examiner* — Charles Freay

(57) ABSTRACT

An energy saving three pump waste water pump station design that eliminates the high energy usage of traditional waste water pump stations, reduces maintenance costs to the pumps and increases the useful lives of the pumps by having a primary pump running continuously, a second pump mining during high demand periods and a third pump functioning primarily as a back up pump. Unlike conventional pump-station designs, the Energy Saving Green Pump Station Design utilizes a single float switch panel. Whereas independent float switches trigger start-stops in conventional pump station designs, the Green design incorporates a remote controllable panel for rotating the primary, secondary and third pumps on a schedule. This design also provides a process for determining in-flow rates for a pump station and efficiency operating points of pumps so that the most efficient pumps with the lowest horsepower can be selected.

1 Claim, 18 Drawing Sheets

OPERATING CURVES FOR ONE, TWO & THREE PUMPS, 80 GPM
POINT OF OPERATION WHEN ONE, TWO, & THREE PUMPS RUN TOGETHER

WASTEWATER INFLOW OVER 24 HOUR PERIOD

WASTEWATER FORECASTED INFLOW INCREASE OVER A 5 YEAR PERIOD (BASE YEAR 2010)

PRIOR ART

SYSTEM CURVE FOR LIFT STATION a - SYSTEM WITH MORE BENDS AND ELBOWS
b - OUR SYSTEM WITH 1000' LENGTH & 4" PIPE
c - SYSTEM LESS RESTRICTED (IE. 1000' OF 5" PIPE)

PUMP EFFICIENCY CURVE

FLOW RATE: 160 GPM

TOTAL HEAD: 60 FEET

IMPELLER: 122 MM

BREAK HP: 4.7HP

EFFICIENCY: 87%

MOTOR RPM: 3600

PUMP CURVE FOR 160 GPM 2 PUMP TRADITIONAL PUMP STATION

OPERATING CURVES FOR ONE AND TWO PUMPS, 160 GPM/EA IN STATION WITH TRADITIONAL DESIGN WITH TWO PUMPS

220 - CASELE ENERGY SAVING GREEN WASTEWATER PUMP STATION DESIGN

P. OF P. = POINT OF PERFORMANCE

FLOW RATE: 60 GPM

TOTAL HEAD: 60 FEET

IMPELLER: 120 MM

BREAK HP: 2.7 HP

EFFICIENCY: 52%

MOTOR RPM: 3600

PUMP CURVE FOR 60 GPM TO BE USED IN ENERGY SAVING GREEN WASTEWATER PUMP STATION

OPERATING CURVES FOR ONE, TWO & THREE PUMPS, 80 GPM
POINT OF OPERATION WHEN ONE, TWO, & THREE PUMPS RUN TOGETHER

SEWER STOCK MAND. PLANT

SEWER STOCK MAND. PLANT

ENERGY SAVING GREEN WASTEWATER PUMP STATION DESIGN

BACKGROUND OF INVENTION

This invention relates to the improved design of waste water pump station pumping systems for the purpose of more efficient utilization and conservation of energy resources. The invention applies to two pump, waste water pump stations as well as pump stations having three or more pumps.

The conventional waste water pump station design employs two or more pumps. In two pump waste water pump station systems, one pump must be large enough to handle the in flow at any given time. The second pump is the stand bye, backup pump. It will turn on if the first pump fails. It also will turn on if, for some reason, the in flow rate exceeds the maximum capacity of the first pump under emergency conditions. The design is very inefficient and maintenance intensive. First off, the primary pump turns on and off each time the volume of fluid in the well reaches maximum and minimum levels respectively. The energy required to turn on a pump is significantly higher than that of a pump running at it's most efficient rate. Also, each time a pump turns off, kinetic energy is lost.

Regarding maintenance costs and useful life, a pump's useful life as provided by manufacturers' specifications, is based on the number of start-stop cycles. A typical life cycle for a pump under this design is approximately 7 years. In addition, maintenance requirements for pumps operating under this design are increased since stagnated waste water accumulating around an idle pump impeller enables debris to enter the immobilized impeller due to loss of the excessive resistant torque of a running pump.

A practical example to readers of all understanding of the energy efficiency and maintenance cost savings that can occur from this invention can be related to the process of an automobile that travels in rush hour traffic verse an automobile that travels at 3 am. Traveling during rush hour, with traffic constantly slowing down (comparative to modern pumps that use variable frequency drives) or stopping and going (comparative to older, less expensive, traditional pumps) results in miles per gallon loss compared to traffic running at the most efficient engine speed of an automobile (driving steadily at 45 mph on average). Also the wear and tear of stopping and going causes more maintenance to an automobile's parts than does that occurring from driving at a constant energy efficient speed. In addition, determining each engine's peak performance speed relating to steady mph provides valuable information as to the highest green performance operating speed.

That is exactly what the inventor does herein. The invention provides calculations required to determine the most efficient horsepower engines to employ in any waste water pump station by use of given formulas and the methods for accumulating the data necessary to establish the components of the formula.

BRIEF SUMMARY OF INVENTION

One object of this invention is to reduce amount of energy to operate a waste water pump station through a green design that utilizes three motors of equal horsepower with the primary pump running continuously, the second pump running when demand exceeds the capacity of the first pump and the third pump serving as a back up, emergency pump. The determination of the most efficient horsepower to be used in the station is based on 24 hour flow rates, well capacity, required head and the discharge force main diameter and length. A system curve calculating the pipe layout having the least friction resistance is also utilized to minimize pump horse power requirements thereby further reducing energy consumption. From this data, the pump performance curve is established providing the most efficient point of operation for the Energy Saving Green Waste Water Pump Station three pump system design which can be compared to that of the inefficient traditional two pump waste water pump station. Similar calculations and the resulting energy savings apply to traditional pump stations with more than two pumps.

The second object of this invention is to reduce maintenance costs and extend the useful lives of pumps in waste water pump stations. This is accomplished by reducing start-stop cycles, reducing heat build up around pumps when they turn off (short cycling resulting in insufficient time for the generated heat of the previous start to be dissipated), reduction of excessive resistive torque from debris to entering impellers in the off position during settling. In addition, this method cycles the three pumps by rotating the primary continuous running pump with the secondary support pump and the backup third pump on a scheduled basis. In this way the pumps are kept at the optimal level of failure resistance unlike pumps in the conventional design.

DETAILED DESCRIPTION OF INVENTION

First we will consider the Traditional Pump Station design with Two Pumps—

Figure 1:
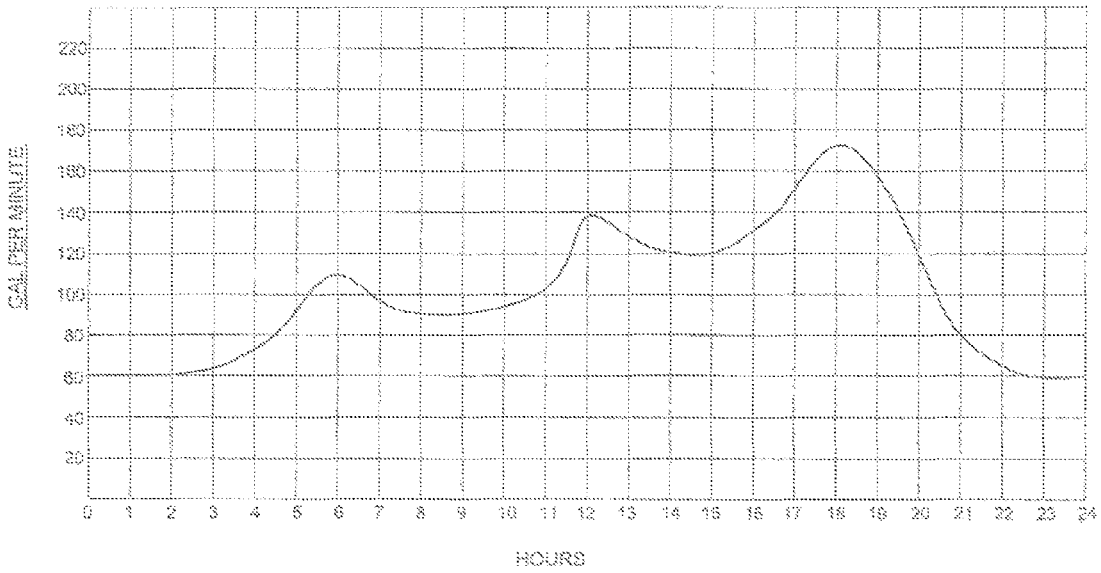
FIG. 1 Waste water in-flow profile over a 24 hour period

This pump station 112 serves a small residential community with the following:

A FIG. 1 shows 24 hours of in-flow 100 in Gallons Per Minute (GPM)

B—The wet well 102 is 8 ft in diameter by 20 ft deep

C—It has two identical 5 HP 104 and 106 submerged pumps

D—Each Pump 104 and 106 has a flow rate of 160 GPM at a total head of 60 ft E—The discharge force main 108 has a 4 inch diameter and is 1000 ft in length, laterally connected to the municipal force main 304.

Case-I

Pump Station with Twin Pumps

Pumps, 160 GPM, 60 ft Head

Conventional Design—

The design of the pump station 112 starts with the in-flow 100 curve over a 24 hour period. This curve is the upper envelope of 365 daily curves in one year in 2010 as shown in FIG. 1. Due to the population increase and improved living standards, in-flow 100 rates should trend toward increasing. This rate of increase can be calculated using the past several years of available data. The data indicates a 4% annual rate of increase. The in-flow 100 curve moving out five years to 2015 can be constructed from the 2010 curve by the formula:

$$Q_{2015}=Q_{2010}(1.04)^5=1.217Q_{2010}$$

where:

Q is the volumetric flow rate (in-flow 100 rate)

Figure 2:
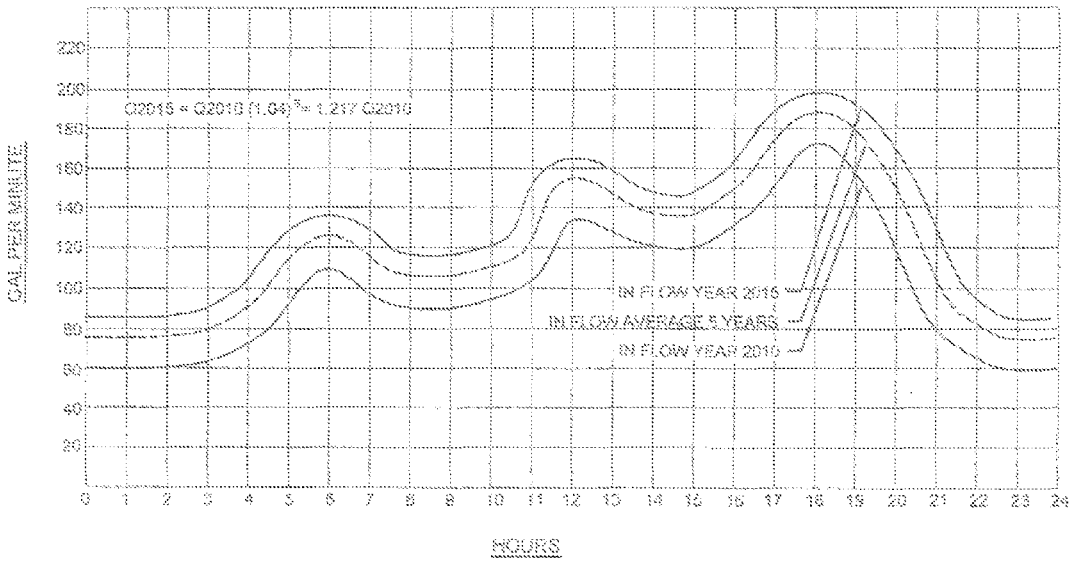
FIG. 2 Waste water in-flow profile over a 5 year period (base year 2010)

The in-flow 100 curves of $Q_{2010}$ and $Q_{2015}$ are shown in FIG. 2. The curve average over five years corresponds to mid year 2012 and was used as the basis for the design and running cost calculations.

Pump Station Design—

Figure 3A:
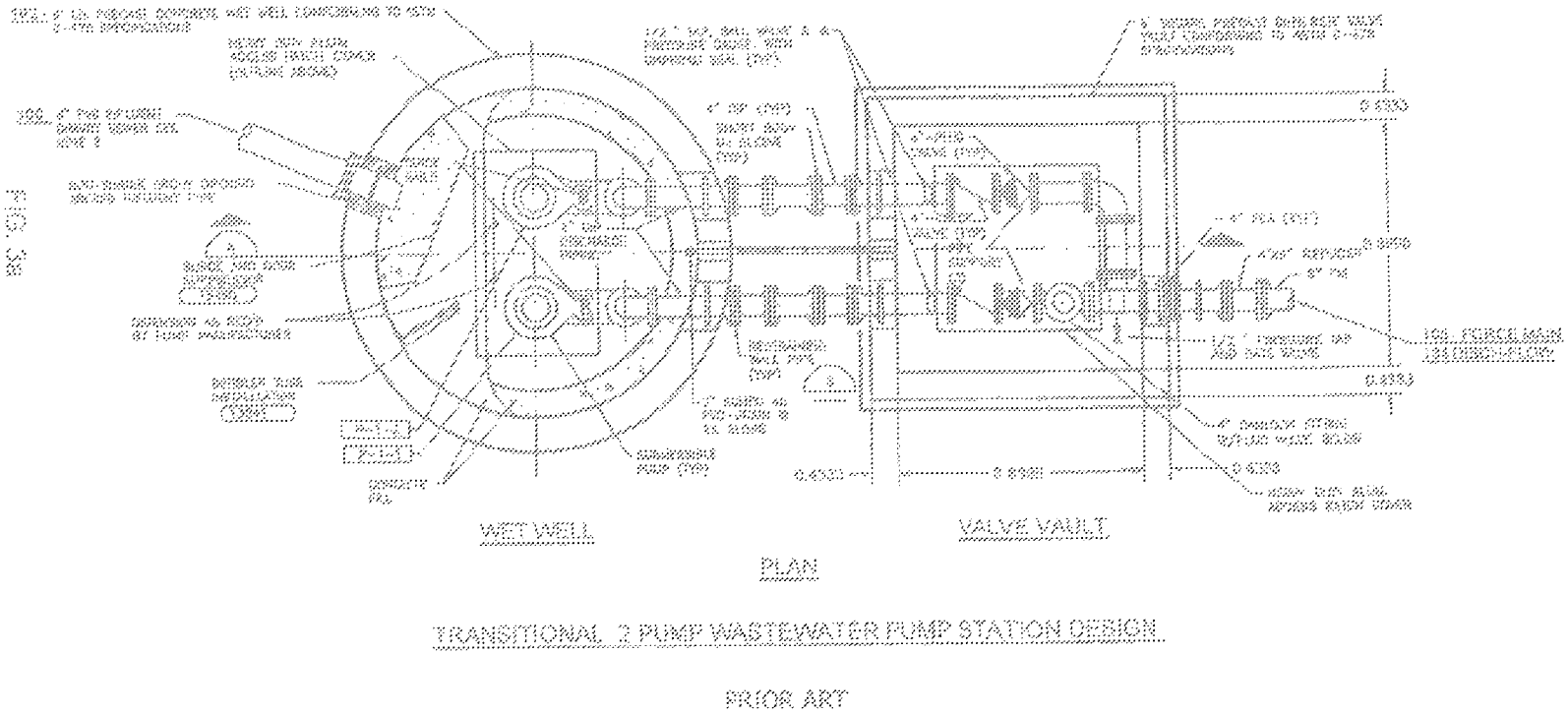
FIG. 3*a* Common residential wet well
Figure 3B:
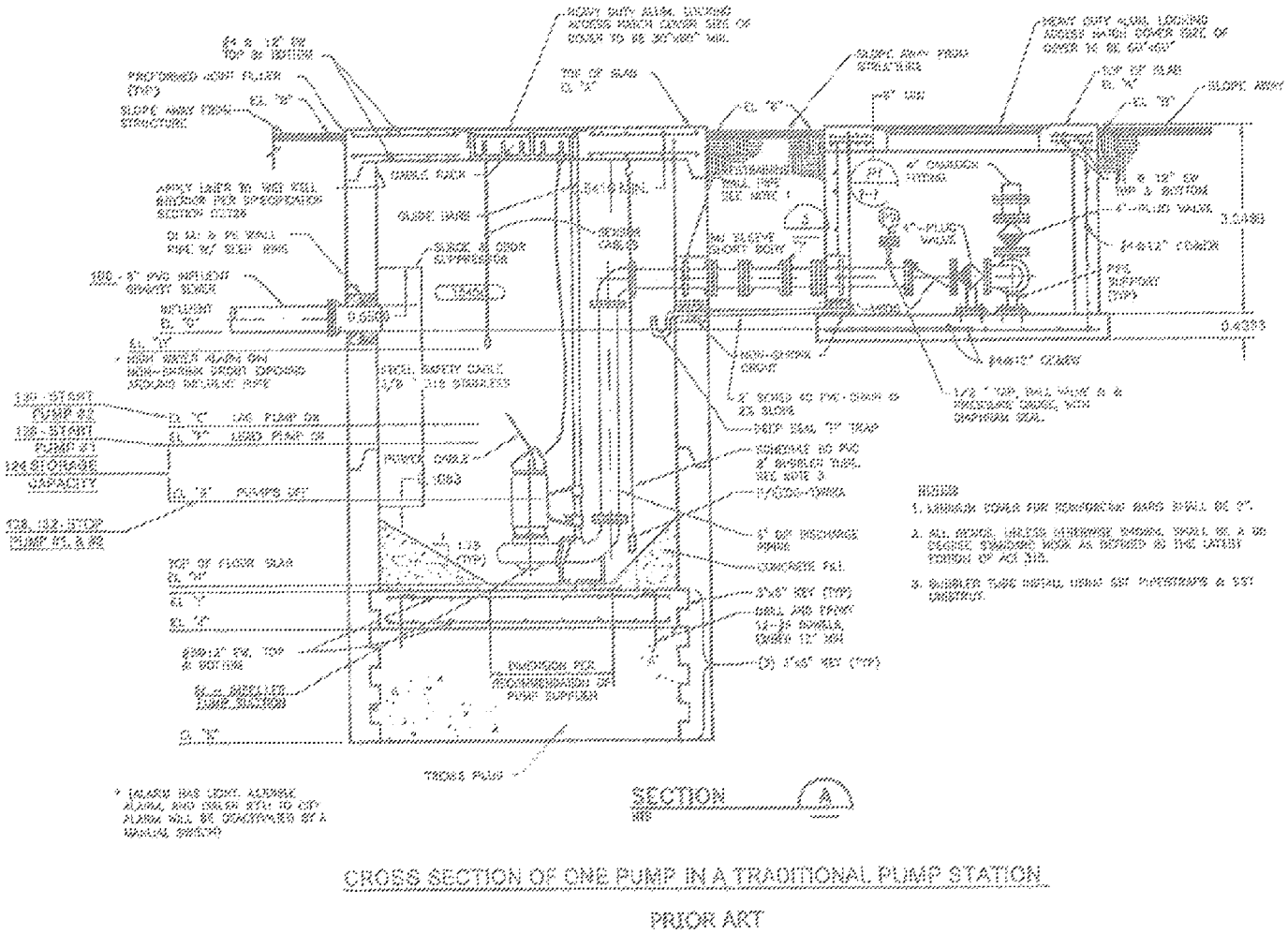
FIG. 3*b* Cross section of one pump design in a common wet well

FIG. 3*a* shows the common wet well 102 design used in residential areas. FIG. 3*b* shows a section of the same common wet well for the operation of one of the pumps so that the start and stop pump levels can be displayed. For two pump systems 112, one pump 104 must be large enough to handle the in flow 100 at any point in time over a 24 hour period and the second pump 106 must be large enough to handle the same in flow 100 as it's sole purpose is to function as a backup pump 106 if pump one 104 fails.

Also, the design assumes the pump station 112 delivers the waste water over 1000 ft of discharge force main 108 latterly connected to the municipal force main 304 pipe with back pressure of 30 ft head.

Pump Requirement—

The average in flow line in FIG. 2, indicates a pump 104 and 106 capacity of 160 GPM is the correct pump 104 and 106 for the system.

$$\underline{D}P=60\text{ ft}-30\text{ ft}=30\text{ ft}=\text{Head loss in 1,000 ft discharge force main }\mathbf{108}$$

In the graph of head loss vs. GPM, for 160 GPM, with a 4 inch diameter discharge force main 108 the pressure loss is $$DP=1.5\text{ ft per a 100 ft length of pipe}$$

The pressure at the entry to the municipal force main 304 is:

$$DP=60\text{ ft}-1.5\times1{,}000\text{ ft}/100\text{ ft}=45\text{ ft.}$$

45 ft of pressure is greater than 30 ft back up pressure (head) and the pump 104 will deliver 160 GPM as required.

If the second pump 106 starts in an emergency situation when the first pump 104 is running, the simultaneous operation of the two pumps 104 and 106 should be examined.

Examination of the Two Pumps—

The flow rate of two pumps 104 and 106 in a 4 inch diameter discharge force main 108 is 320 GPM. This flow rate in the 4 inch ductile pipe 108 has a pressure drop of 5.5 ft per 100 feet of length. Therefore, the total pressure drop at the point of connection to the municipal force main 304 will be $$DP=(5.5\text{ ft}/100\text{ ft})\times1{,}000\text{ ft}=55\text{ ft}$$

The net positive pressure of the pumps 104 and 106 will be 60 ft pump head−55 ft pressure drop=5 ft net positive head at the end of the 4 inch discharge force main pipe 108. 5 ft head is smaller than 40 ft back pressure. This means the delivery of 320 GPM to the municipal force main 304 is impossible and the total flow rate of two pumps 104 and 106 will reduce until the pressure drop in the pipe is reduced from 5.5 ft/100 ft to 2 ft/100 ft and the flow rate of both pumps 104 and 106 is about 190 GPM.

Pump Selection—GPM—

The GPM of the pump 104 and 106 can be determined from the maximum GPM of in-flow 100 in FIG. 2 and the storage capacity of the wet well 102. In this case, a pump 104 with 160 GPM alone is able to handle the maximum in-flow 100 in a 24 hr period up to year 2013. Beyond that, the second pump 106 will start when the water level reaches an elevation of 16 ft 130. Now both pumps 104 and 106 jointly discharge 108 about 200 GPM until the water level goes down to 10 ft 132.

Total Head—

The total head in the pump 104 and 106 is the pressure at the discharge 108 of the pump in feet of water less pressure at the pump suction point 114 (the entry of water to the impeller). The suction pressure is positive for submerged pumps and negative for above the well pumps.

Head Requirement—

The required head in a pump station 112 is the total pressure head at the discharge point 108 of the pump 104 and 106 that is created by the pump 104 and 106 to deliver a certain flow rate (GPM) in a specified pipe 108 against the amount of back pressure at the end of the pipe 304. The required head can be calculated by the following equation:

$$H=hp[\text{Depth of pump }\mathbf{104}\text{ and }\mathbf{106}\text{ in respect to municipal force main }\mathbf{304}\text{ elevation in ft}]-hs[\text{suction pressure + or − in ft}]+f\times L/D\times V^2/2g[\text{head loss by friction in ft}]+V^2/2g+h_{bu}$$

where:

hp—the vertical depth of pump 104 and 106 from force main 108 elevation hs—is the suction pressure at the entry to the impeller 114 in feet of water where suction pressure is positive when the impeller 114 is submerged and negative in above ground pumping.

L—is the total length of the discharge force main 108 from pump discharge to the point of connection to the municipal force main 304 in feet D—is the diameter of pipe 108

V—V is fluid velocity in the pipe 108 in ft/second g—is the rate of gravitational acceleration (gravity)=32.3 ft/sec$^2$ f—is the friction coefficient of the pipe 108 and in ductile iron, the friction coefficient is between $1.85\times10^{-2}$ to $2.0\times10^{-2}$ (friction is dimensionless)

$h_{bu}$—is the back-up pressure and is the pressure inside the municipal force main 304 at the point of pipe connection 308 in feet of water Using 160 GPM 104 and 106, 40 feet of water back pressure and a 4 inch ductile iron pipe 108 diameter, 1,000 ft equivalent length of pipe 108 (considering all bends, elbows, etc) in above equation, the total head loss is 55 to 65 feet of water. Here the head loss of 60 feet corresponds to the 35 ft back pressure that was selected.

System Curve, Pump Curve and Operating Point—

At this stage, the pump station 112 discharge 108 flow rate (GPM) and the total head loss have been determined and it is time to select the best pump 104 and 106 for the station from a group of available pump projects. To do this, the following terms need to be explained:

A—The System Curve—

Figure 4:
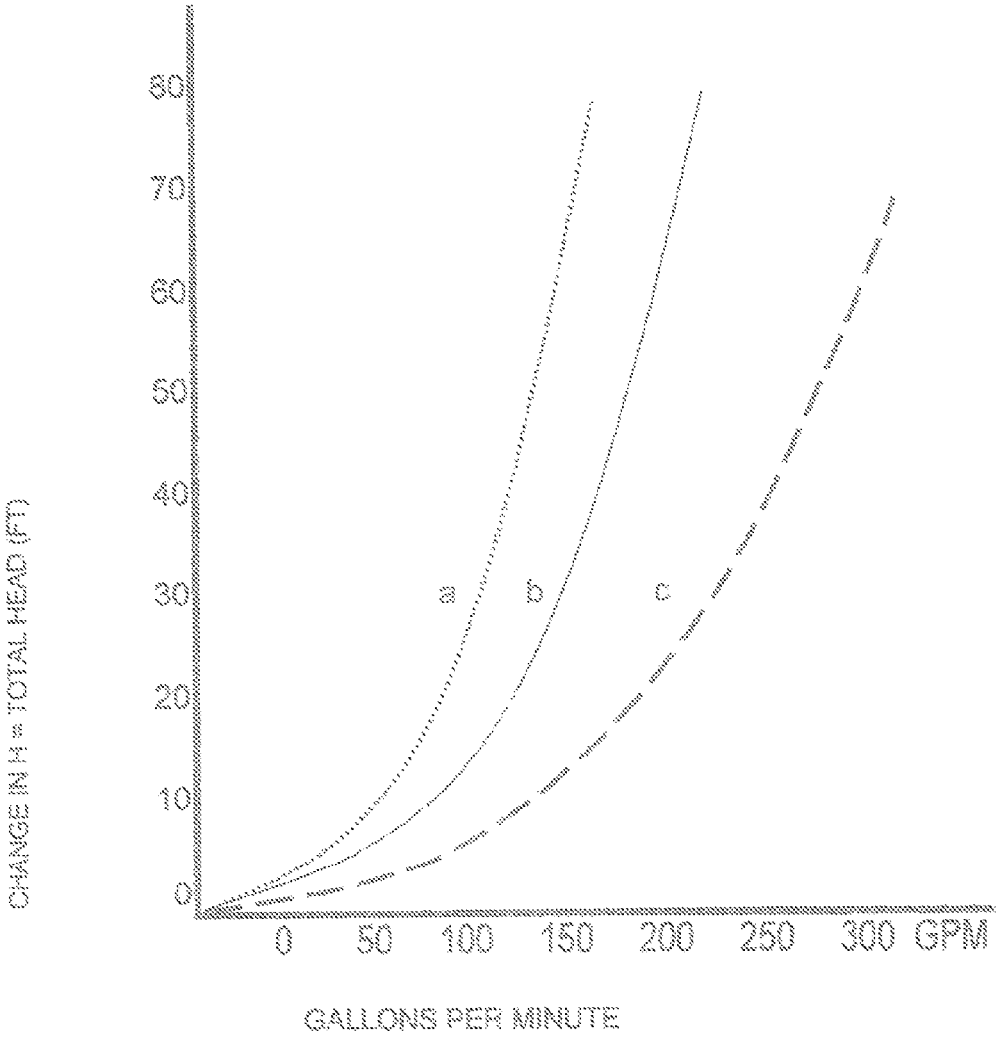
FIG. 4 System head loss curve

In a pump station 112, a length of the discharge force main 108 starts from the pump's discharge point 120 and ends at the point of connection 308 to the municipal force main 304. The length of the straight pipe, the elbows and any bends in the discharge pipe 108 restrict or resist the flow of the waste water resulting in head loss. The system head loss is the summation of the friction loss of all components of the piping system as shown in FIG. 4. The head loss in the piping system 108 (system head loss) can be calculated by the following equation:

$$DH = f \times L/D \times V^2/2g + V^2/2g \text{ LOSS OF VELOCITY AT ENTRY TO THE MAIN 304}$$

where

DH is the system head loss in a foot of water f—is the friction factor, dimensionless, and is related to the smoothness of the inside of the pipe 108.

L—is the total length of the discharge force main 108 from pump discharge point 120 to the point of connection 308 to the municipal force main 304 in feet D—is the diameter of the pipe 108

$f \times L/D \times V^2/2g$—is the portion associated with the friction of the pipe 108 and the fittings 108

$V^2/2g$—is the kinetic energy of moving fluid at the point of entry 308 into the municipal force main 304 g—is the earth's gravitational acceleration equivalent to 32.2 ft/sec

In the design of a pump station 112, the values of f, L, D, and g are constant. Therefore, the DH on the Y axis and GPM on the X axis (see FIG. 4) can be rearranged as a function of the variable V.

B—The Pump Curve—

Pump 104 and 106 manufacturers with a specific pump casing and a particular impeller 114 have a number of products with varying motor horsepower, RPM specifications and impeller 114 diameter. But all products of one group of pumps have the same performance characteristics and varying capacities.

In order to simplify the use of those pumps, manufacturers provide the graph of pump operations under differing conditions. The pump curves are identified as 5", 5½", 6", 6½" and 7" diameters. All of the curves are parallel to each other and each shows the pump operating at different conditions.

Break Horse Power Curves—

Figure 5:
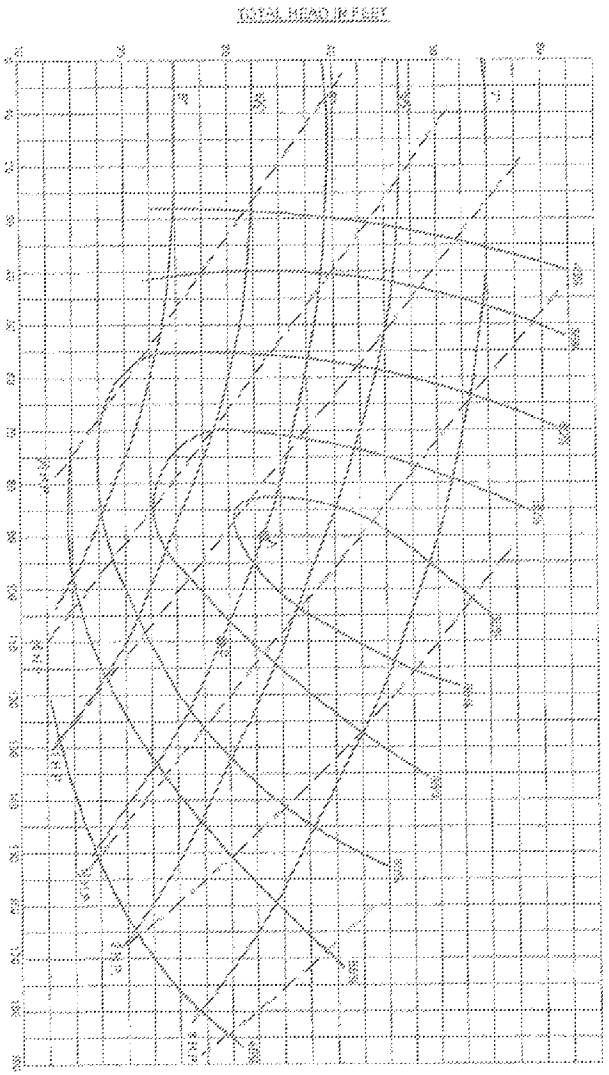
PRIOR ART FIG. 5
FIG. 5 Point of most operation at highest efficiency curve

A group of straight, broken lines slanted from left to right with each line representing one motor with the identified HP operating under different conditions (FIG. 5). The power of the motors for these lines range from ½ HP to 3 HP. For all operating points on the left hand side of the line, the pump will operate safely without the motor becoming overloaded. For all operating points to the right of the line, the motor will be over loaded and the over load protection mechanism will shut off the motor.

The Efficiency Curves—

In FIG. 5, a group of half ellipse lines ("u" shaped lines) representing efficiency. The curves are identified as 45%, 55%, 60%, 65% and 68%. All points located on the 60% curve will have a 60% operating rate of efficiency.

C—The Point of Operation—

In coordinates of "Head vs Flow Rate", any point could be an operating point of a pump where it's curve passes through that point. In FIG. 5, the points "A" & "B" are operating points of a 1½ HP pump with a 6" impeller. The efficiency of point A associated with 90 GPM and 33 ft head is about 70% while point B is the same pump operating with 110 GPM and 28 ft head resulting in a 64% rate of efficiency.

Pump Station Design Point of Operation—

The pump station point of operation is the intersection of the pump station pump curve and the system curve. The pump works under this condition as long as the position of the system curve and the pump curve does not change. Any changes in back up pressure in the public force main 304 or changes in the wet well 102 water level, could move the operating point of the pump to the right or to the left along the pump curve. However, it is safe to assume that the pump will operate at the design point more than 90% of the time. THE BEST DESIGN IS THE ONE WHICH HAS THE OPERATING POINT INSIDE THE HIGHEST EFFICIENCY CURVE, LIKE POINT A VS. POINT B.

A Good Pump Station Design—

A good design is one where the pumps operate at the highest efficiency point over the longest period of time, avoid excess hp and minimize start/stop occurrences. To determine the most efficient design, the following steps need to be taken:

1—From an in-flow 100 profile over a 24 hour period, the required GPM will be determined 2—back-up pressure at the end point of the pump station force main 124 will be obtained 3—wet well 102 dimension, location of the pump 104 and 106 in respect to the force main 108 elevation and pump suction pressure 114 need to be determined 4—Having obtained the design of the force main 108, a system curve can be plotted by:

a—Finding several points occurring at different GPM rates b—using the parabola equation 5—The desired design point of operation is the intersection of the system curve and the vertical line of constant GPM 6—Select the pump 104 and 106 HP in which the point of operation falls in the center of the efficiency curve at the highest point.

7—If this point is between two operating curves, the operating curve of the pump 104 and 106 can be adjusted by increasing or decreasing the impeller 114 size.

Figure 6A:
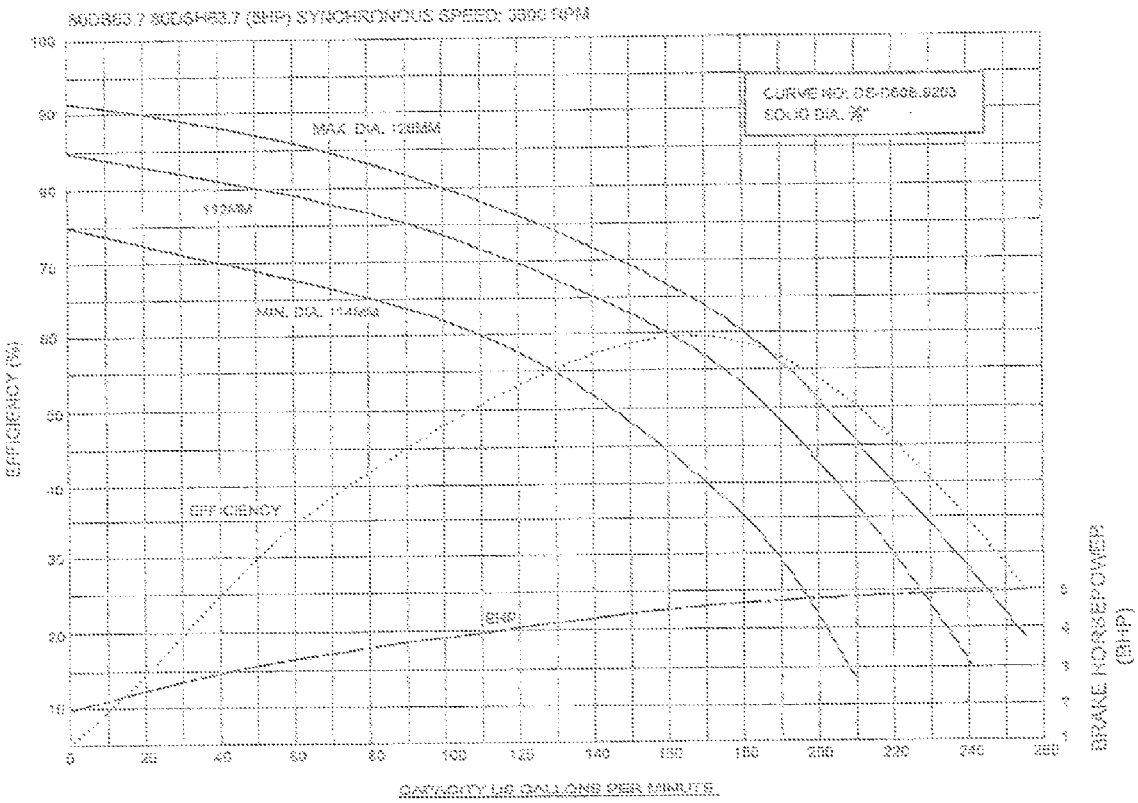
PRIOR ART FIG. 6a
FIG. 6*a* Pump performance curves to determine efficient impeller size
Figure 6B:
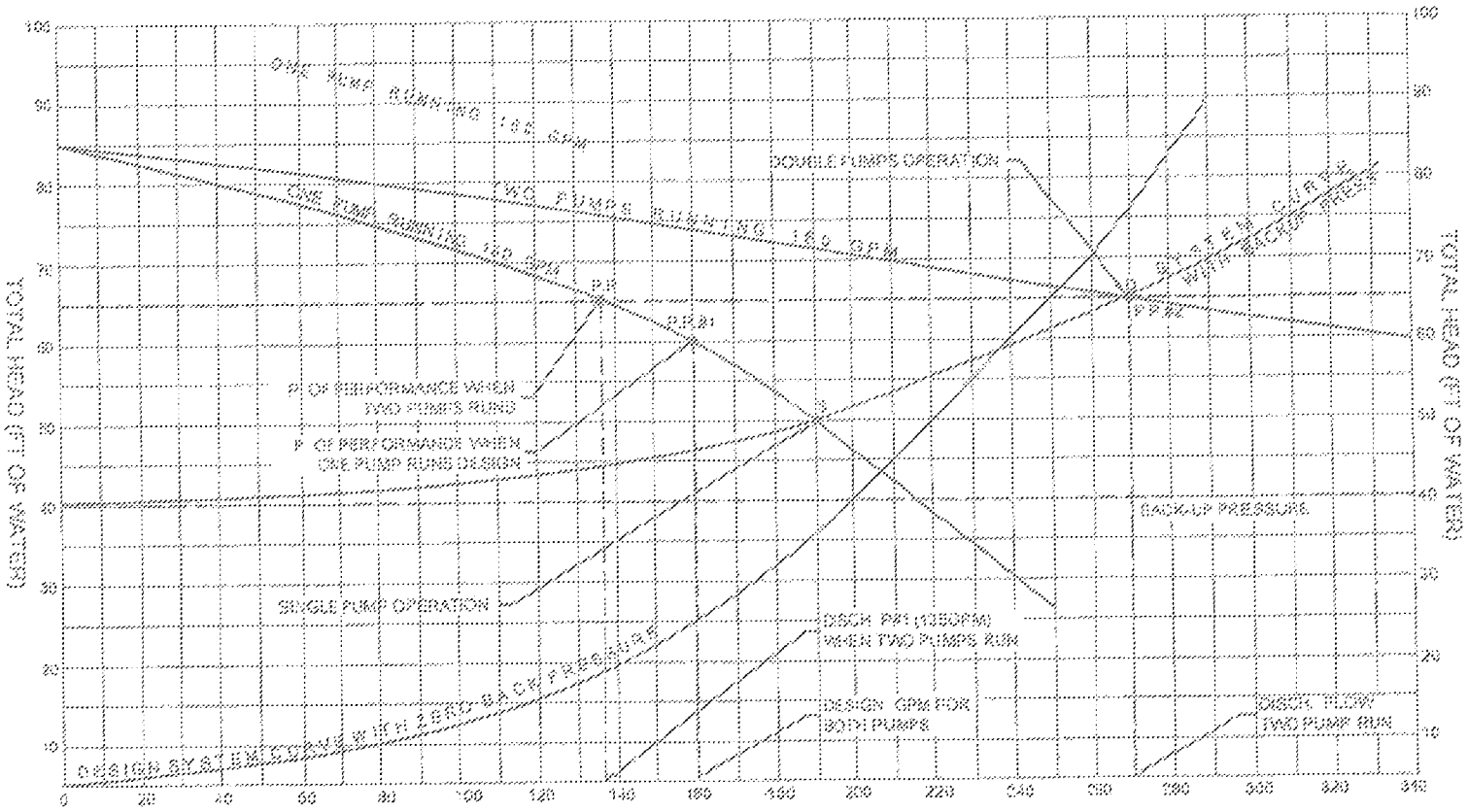
PRIOR ART FIG. 6b
FIG. 6*b* Operating curves for one and two pumps-traditional pump-station

Study of a Traditional Vs the Energy Saving Green Waste Water Pump Station Design Case I Traditional Waste Water Pump Station with Two Pumps 160 GPM, 60 ft Head Each Pump The product of EBARA INTERNATIONAL CO. has been used in this study. For a pump station with two pumps 104 and 106, 160 GPM, a total head of 60 ft of water, the submersible pump 104 and 106 from the group of DSU of EBARA was selected as:

Model No. 80 DS63.7, 5HP, Synchronous Speed of 3600 RPM, 3" Discharge, Solid Diameter ⅜". The pump 104 and 106 performance curves are given in FIG. 6*a* and FIG. 6*b*.

In this graph, the point of operation is between two curves of impeller 126 mm and 114 mm. The impeller of 126 mm should be trimmed down to 308.5 mm.

Wet Well 102 Dimension & Storage Capacity—

Wet wells 102 usually are in the shape of a cylinder and are constructed from reinforced concrete. In addition to housing the pumps 104 and 106, the wet well's 102 function as a fluid storage container that regulates the discharge flow 134. The storage capacity of several wet wells 102 for one ft. of elevation is given in TABLE 1 below:

TABLE 1

| | | WETWELL DIAMETER | | | | | |
|---|---|---|---|---|---|---|---|
| DESCRIPTION | DIMENSION | 6 FT | 7 FT | 8 FT | 9 FT | 10 FT | 12 FT |
| SECTION AREA | FT2 | 28.26 | 38.47 | 50.24 | 63.58 | 78.5 | 113 |
| STORAGE CAPACITY VOLUME OF 1' HEIGHT | $FT^3$ | 28.26 | 38.47 | 50.24 | 63.58 | 78.5 | 113 |
| STORAGE CAPACITY VOLUME OF 1' HEIGHT | GALLONS | 212 | 288 | 375 | 476 | 587 | 846 |

The wet well 102 of 8 ft diameter×20 ft depth has been selected. The float control switches 126, 128, 130 and 132 have been installed as (TABLE 2):

TABLE 2

| PUMP #1 | ELEVATION FROM WELL BOTTOM | PUMP #2 | ELEVATION FROM WELL BOTTOM |
|---|---|---|---|
| START FLOAT SWITCH | 9 FT | START FLOAT SWITCH | 16 FT |
| STOP FLOAT SWITCH | 3 FT | START FLOAT SWITCH | 10 FT |

The storage capacity from the starting point 126 of the pump 104 to the stopping point 130 of the pump 106 is 2255 gallons. The time for a pump 104 and 106 cycle (time from start to stop) will be:

Time/Cycle=2255 Gallons/(160−in-flow 100 GPM)

Figure 7:
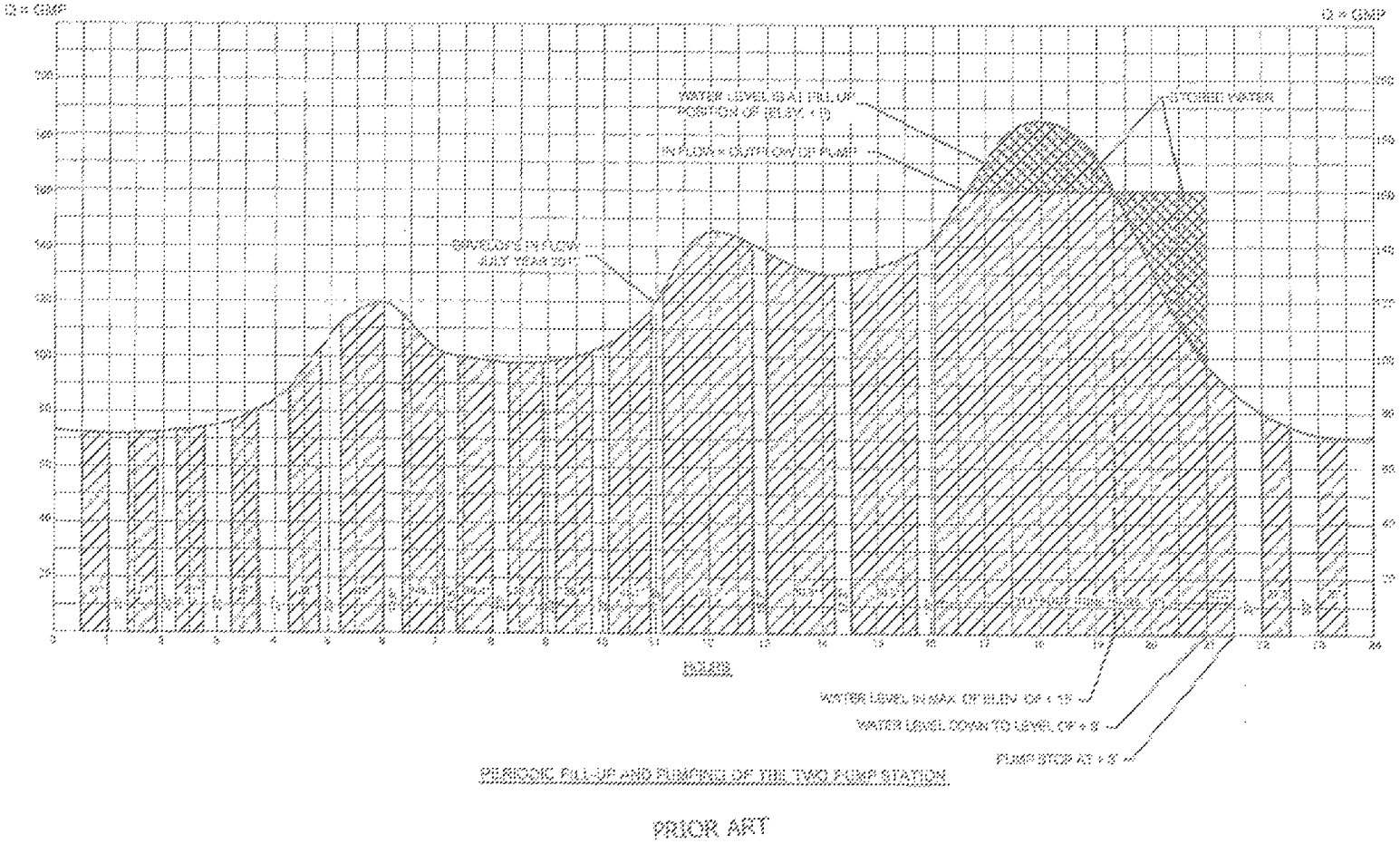
FIG. 7 Operating times for traditional pump-station pumps in CASE I

Apply the time-pump cycle FIG. 7 to the in-flow profile FIG. 1. and the operating time of the pump 104 and 106 over a 24 hour period can be calculated in this scenario. FIG. 7 shows the timing of each start and stop in this scenario. As soon as the water level reaches an elevation of 3 ft, the stop switch 126 will trigger the pump 104 to stop. The fill up period starts and the water level continues to rise by the in-flow 100. When the water level reaches 9 ft, the start switch 126 runs the pump 104. If the in-flow 100 at that time is 90 GPM, then the pump 104 working period will be:

pump 104 working time=2255 gallons/(160−90)=32.2 minutes

All pump 104 and 106 working times have been calculated and are given in FIG. 7. The pump 104 and 106 running time over 24 hours is given in FIG. 8. After three years, the wet well 102 storage capacity cannot handle the high in-flow 100 and the second pump 104 and 106 will start. The power consumption of the pump station is given by FIG. 9. According to this graph, the power demand will be 107.6 amps.

Case-II

Pump Station with Three Pumps 220

80 GPM, 60 ft Head Each Pump

In this design 220, the same in-flow profile for 24 hours of FIG. 1 was used. The pump station 220 has the following specifications:

1—The wet well 200 is a concrete cylinder of 8 feet diameter with a depth of 18 feet.

2—The lateral force main 126 is a 4 inch pipe and identical to the design of the two pump waste water pump station 112; therefor, the system curve is the same and the total head for the pump station will be 60 feet.

3—The design pump 224, 226 and 228 GPM, in contrary to the two pump system 112, is associated with the minimum in-flow rate which is almost 50% of the maximum in-flow. The flow rate of 80 GPM has been selected for the pumps 224, 226 and 228.

4—The pump station has three identical pumps 224, 226 and 228, each with 80 GPM and a total head of 60 feet of water.

5—In this design, the effort was to modify the traditional two pump station 112 to a more efficient one 220 for the purpose of analysis and comparison of the running cost of the two systems.

6—Only the pump 224, 226 and 228 GPM and wet well 200 depth have been changed so that in CASE II, the wet well 200 has a depth of 18 feet and pumps 224, 226 and 228 with 80 GPM rating have been selected.

Figure 10:
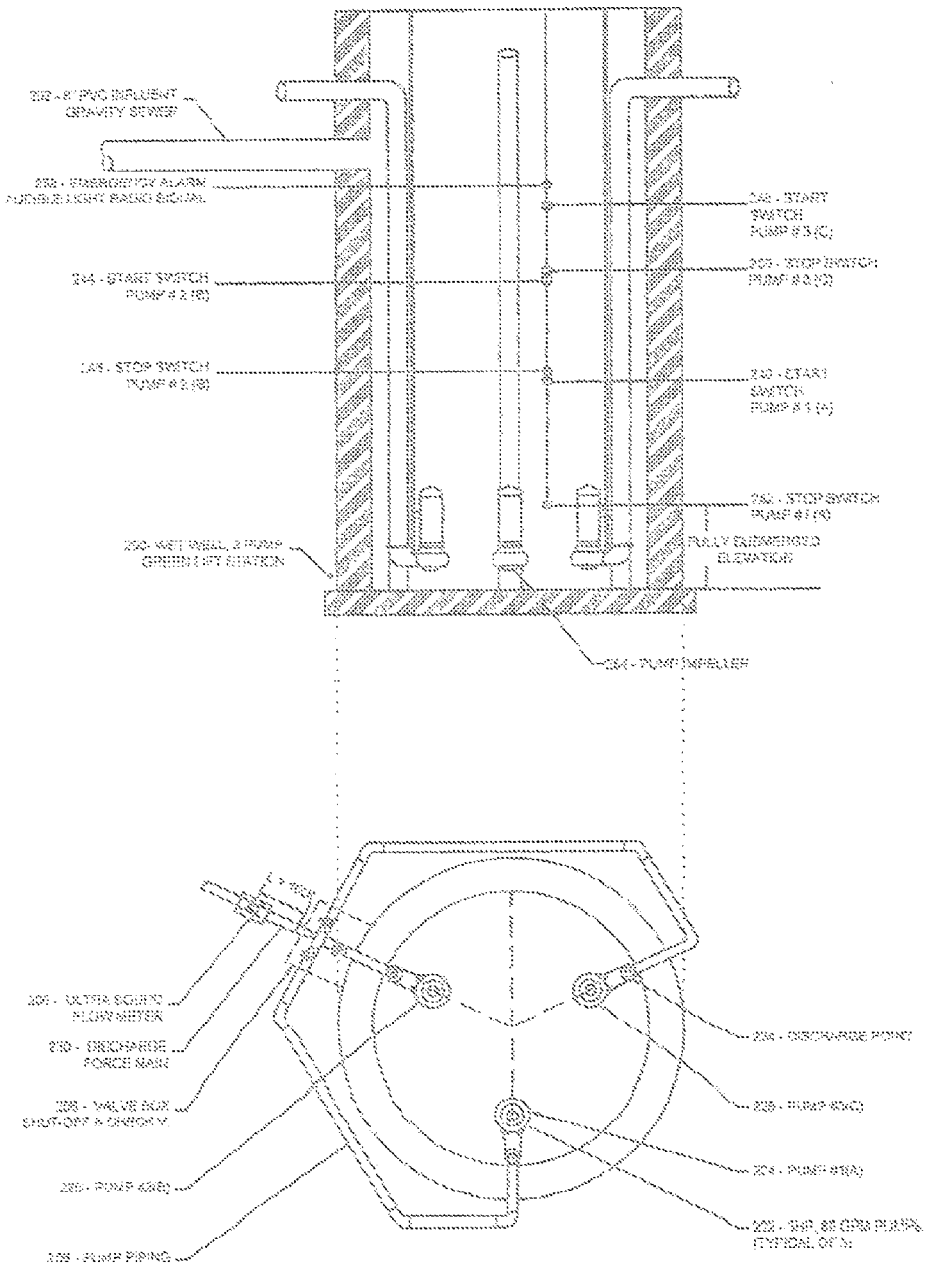
FIG. 10 Green pump station with three identical pumps

7—The pump 224, 226 and 228 location, float switches 240, 242, 244 and 246 of the control system and the piping design are shown in FIG. 10.

Design of Green Pump Station 220—

The procedures of the design for the Green Pump Station 220 are as follows:

1—From the given curve envelope of a 24 hours in-flow profile FIG. 1, the required GPM for a pump 224 associated with continuous in-flow will be determined.

2—At the end point of the force main 306 connected to the public force main 304 is to be selected.

3—Depending on the location of 1) the pump station 220 and 2) the total flow rate corresponding to the three pumps 224, 226 and 228 running simultaneously and 3 the back-up pressure and 4) the pump piping 252, a force main 230 with a low head loss will be designed 4—The system curve for the pump station can be plotted by a point to point calculation or by using the parabola equation.

5—The point of performance for one pump 224, 226 and 228 with GPM from item 1 above and head loss associated with the maximum flow in the force main 230 (when three pumps 224, 226 and 228 are running together) will be found on the system curve.

6—A pump 224, 226 and 228 with a pump 224, 226 and 228 curve passing through the point of performance will be selected in such a way that the point of performance falls inside the highest efficiency curve and nearest to the left hand portion of the high efficiency curve. When two pumps 224 and 226 are running, the point of operation moves toward the right and slightly up. By proper selection of the point of performance closest to the left portion of the high efficiency curve, the new point of performance of two pumps 224 and 226 still remains inside the high efficiency curve.

7—Power consumption in the three pump system 220 is associated with continuous power from the network but having a much smaller rush in current. The rush in current (lock rated amps) for the two pump system 112 having 5 HP pumps 104 and 106 is 93 amps for the primary pump 104 and 107.6 amps when the second pump 106 starts to run. In the three pump system 220, the rush in current for the first pump 224 to start is only 59.6 amps and for the second pump 226 to start is only 66.3 amps.

8—The minimum in-flow 24 hour profile dictates the number of pumps required for the pump station and not the magnitude of the maximum in flow.

9—The total number of pumps required in a given pump station is the number needed to handle the maximum flow plus one pump as a spare.

Pumps Operating Time—

In this case, the wet well 200 is an 8 foot diameter cylinder with an 18 foot depth. It has three identical pumps 224, 226 and 228 of 80 GPM with 60 feet of water total head. The in-flow profile of FIG. 1 was the basis of the design. The wet well 200 storage capacity for pump 224, 226 and 228 cycling is the volume of the water between the start 240 and stop 246 switches (6 feet). This capacity is 2255 gallons and the time for the pump to cycle (pump operating time from start to stop) will be Time/Cycle=2255/(80 GPM−In-Flow GPM)

Float Switch Panel—

Unlike conventional pump-station designs, the Energy Saving Green Pump Station Design 220 utilizes a single float switch panel. Whereas independent float switches trigger start-stops 126, 128, 130 and 132 of the conventional pumps 104 and 106, the Green design 220 incorporates a remote controllable panel for rotating the primary, secondary and third pumps 224, 226 and 228 on a schedule. The rotation reduces stress on a single pump by design.

In the three pump Green Pump Station Design 220, Pump 1(A) 224 runs continuously after initial start up and only turns off for maintenance or monthly primary pump rotation. On the other hand, the pump 224 running time and the pump 224 cycling depends on the elevation difference between the start 240 and stop 242 switches for Pump 2(B) 226.

Pump Selection—

In this design 220, for comparison purposes with the two pump system 112, the same pump product manufactured by Ebara International Co. has been used.

Three pumps of 80 GPM 222, total head of 60 ft of water, submersible from the DSU group of Ebara was selected as Model No. 50 DS62.2 with 3 HP synchronous 3600 RPM speed, 2 inch discharge, solid diameter of ⅜ inches.

Figure 11:
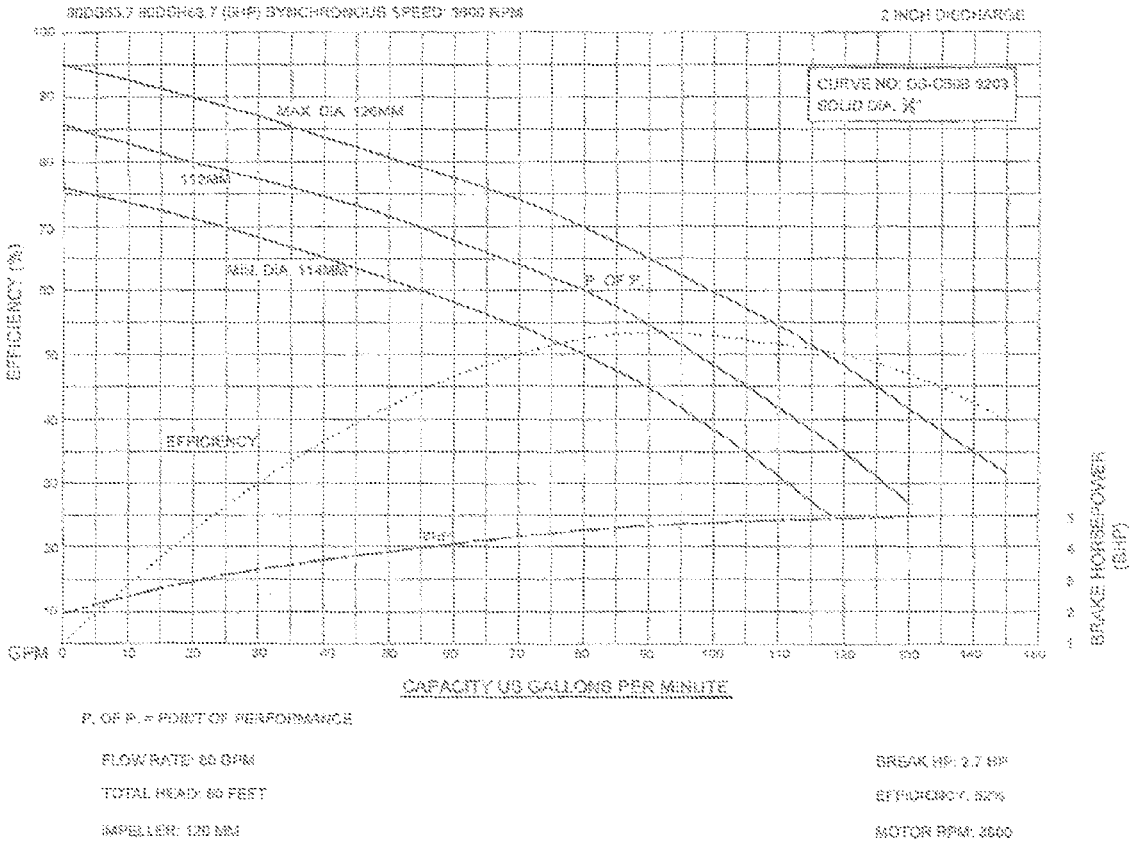
FIG. 11 Pump curve for a 80 GPM pump to be used in the Energy Saving Green Waste Water Pump Station FIG. 12 Operating curves for pumps one, two and three in the Energy Saving Green Waste Water Pump Station FIG. 13 Operating times for pumps one, two and three in the Energy Saving Green Waste Water Pump Station FIG. 14 Operating times of pumps one, two and three in the Energy Saving Green Waste Water Pump Station FIG. 15 Current Vs. Time for the three pumps in the Energy Saving Green Waste Water Pump Station

The pump performance curve is given in FIG. 11. In this graph, the point of operation falls between two curves of maximum diameter of 128 mm and minimum diameter of 114 min. By linear interpolation, the impeller 254 diameter is determined to be 120 mm. The curve parallel to the maximum and minimum curve passing through the point of performance will be the operating curve for the pump 222 (FIG. 11).

Operation of Pump 2(B)—

When Pump 1(A) 224 is running, most of the time the rate of in-flow is higher than the pump discharge rate. The wet well 102 stores this excess flow and the water level will be elevated. The stored water from an 8' elevation to a 14' elevation (which is Pump 2(B)'s stop switch and start switch elevations) is the pump fill up capacity. For a wet well 102 with 8 foot of diameter, this fill up capacity is equal to 2255 GPM. The fill-up time is calculated in the following equation:

(Fill-up)Time=2255 GPM/(In-Flow GPM−80 GPM) in minutes

When the water level reaches an elevation of 14', Pump 2(B) will start and run until the water goes down to the 8' level at which time the stop switch 246 turns off the motor. The operating time of Pump 2(B) 226 is given by the following equation:

Pump 2(*B*) 226 Running Time=2255 Gallons/(180 GPM−In Flow) in minutes

The Fill-up time and the running time for Pump 2(B) 226 have been calculated over a 24 hour period using the 5 year in-flow profile of FIG. 2 (the middle curve). Those calculations have been summarized in FIG. 13. The pump curve, when two pumps (A & B) 224 and 226 are running, and the point of operation associated with a single pump running 224 and two pumps 224 and 226 running is given in FIG. 12.

Operation of Pump 3(C)—

After three years of pump station operation, operating two pumps 224 and 226 together cannot handle the in-flow during peak hours. The increase of the in-flow could be due to normal population increases or unexpected dumping of fluids from other places into the wet well 200.

In this case, the elevated water level will activate the emergency switch and Pump 3(C) 228 will start. All three pumps 224, 226 and 228 run together until the water level drops down to an elevation of 12'. At that time, the stop switch of pump (3)C 228 will turn the pump 228 off while the first two pumps 224 and 226 continue operating together.

Figure 12:
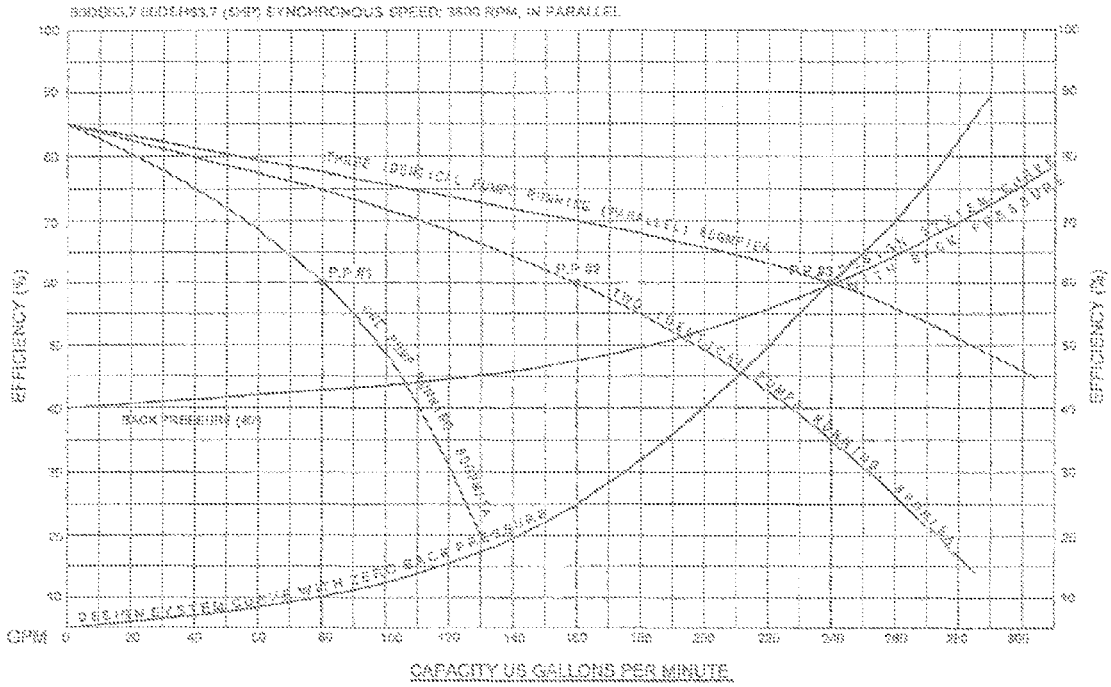

FIG. 12 shows the design system curve, the three pump 224, 226 and 228 operating curve, the operating point of each pump 224, 226 and 228 when working together as points P.P#1, P.P.#2 and P.P.#3. In this graph, point P.P.S is the point of operating Pump1(A) 224 as the single continuous running pump, point P.P.D as the point of operation when two pumps 224 and 226 are running and point P.P.T as the point of operation when all three pumps 224, 226 and 228 are running.

Comparison of the Green Pump Station with Three (3) 80 GPM Pumps Vs. the Traditional Pump Station with Two (2) 160 GPM Pumps—

In this section, the two pump stations discussed in Case I 112 and Case II 220 above have been compared and related parameters have been examined. Comparisons of construction costs, maintenance, energy consumption and budgetary operating costs over the life of the pumps are presented at the end of this section.

1—Wet Well 102/200—

The wet well 102/200 dimensions depend on the physical dimension of the pumps, storage capacity for controlling pump cycling and pump station discharge regulation. It is determined as follows:

a—The Wet Well 102/200 Diameter—

The wet well 102/200 diameter is restricted by pump dimensions. In the two pump system 112, two pumps 104 and 106 are located on one diameter and in the three pump system 220, the pumps 224, 226 and 228 are located 120 degrees off each other. Both the Three Pump Green Pump Station 220 and the traditional pump station with two pumps 112 require the same wet-well diameter 224, 226 and 228 (see FIG. 10). Since both designs require the same wet-well diameter 224, 226 and 228, all two pump systems 112 can be retrofitted to the Green Pump Station Design 220 without any limitations in the diameter of the existing well.

b—The Depth of the Well 102/200—

Two Factors Determine the Depth of the Well 102/200 b—1 The depth of the well 102/200 should be at least 2.5 feet lower than the deepest in-flow entry 100/202 b—2 Storage capacity for pump cycling regulation

In the two pump system 112, this storage capacity 124 is the amount of water stored between the start 126 and stop 128 switch elevations of Pump 1(A) 104. The larger the distance between the start 126 and stop 128 switch elevations, the greater the storage capacity 124. Greater storage capacity 124 results in longer pumping periods and less pump cycling.

In the three pump Green Pump Station Design 220, Pump 1(A) 224 runs continuously and does not have start or stop settings. On the other hand, the pump 224 running time and the pump 224 cycling depends on the elevation difference between the start 240 and stop 242 switches for Pump 2(B) 226. Therefore, in the two pump system 112, the start 126 and stop 128 switch setting for both pumps 104 and 106 are crucial while in the Green Pump Station 3 Pump System 220, only the switch settings 240 and 242 of Pump 2(B) are of concern.

Comparing the two pump system designs 112 and 120, in regards to wet well 102 and 200 depth, the Green Pump Station 3 Pump System Design 220 enables a pump station 220 to be built shallower and cheaper than one built using the conventional two pump waste water pump station design 112.

c—Setting of Pump 1(A) Stop Switch 128 in the Two Pump System Design 112—

The stop switch location of Pump 1(A) 128 in respect to the impeller inlet of Pump 1(A) 114 is important for the following reasons c—1 Pump 1(A) 104 must remain fully submerged at all times for heat dissipation, especially the motor.

c—2 Negative pressure, due to dynamic fluid motion [$(V^2/2g)$ where g represents gravity] at the suction side of the pump 114 could create cavitation and vibration both being harmful to the motor.

c—3 If the setting is too low, the water level drops near the suction inlet 114 enabling floating objects like dead animals to be sucked into the pump potentially causing damage to the pump 104 or burning up the motor.

These concerns do not influence a well in the Green Pump Station Design 220. Once the Green Pump Station 220 becomes operational and an 8 ft water level is achieved, power to the pump station 220 is turned on and Pump 1(A) 224 runs indefinitely.

Figure 8:
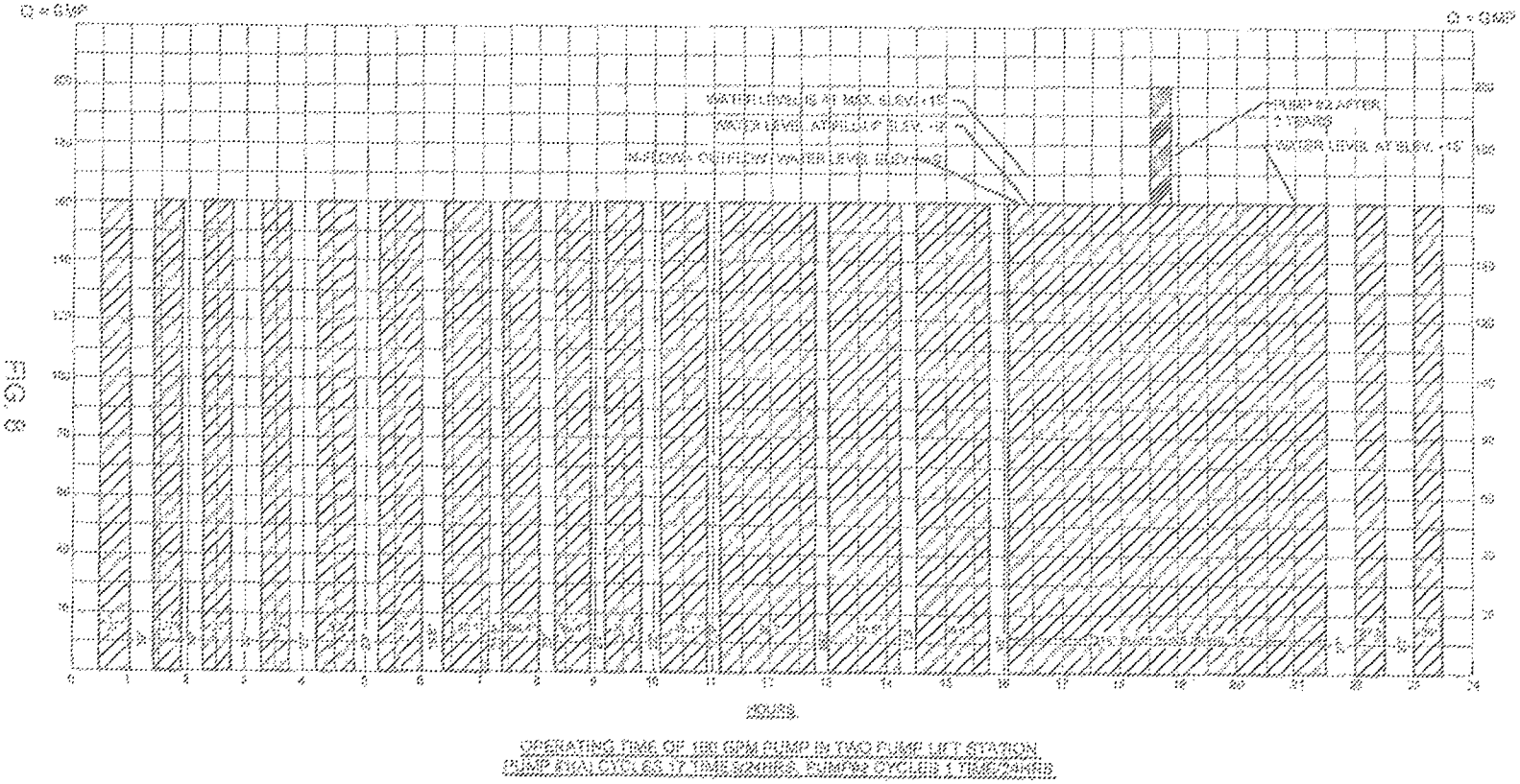
FIG. 8 PRIOR ART
FIG. 8 Operating time of a 160 GPM pump in a traditional pump-station
Figure 14:
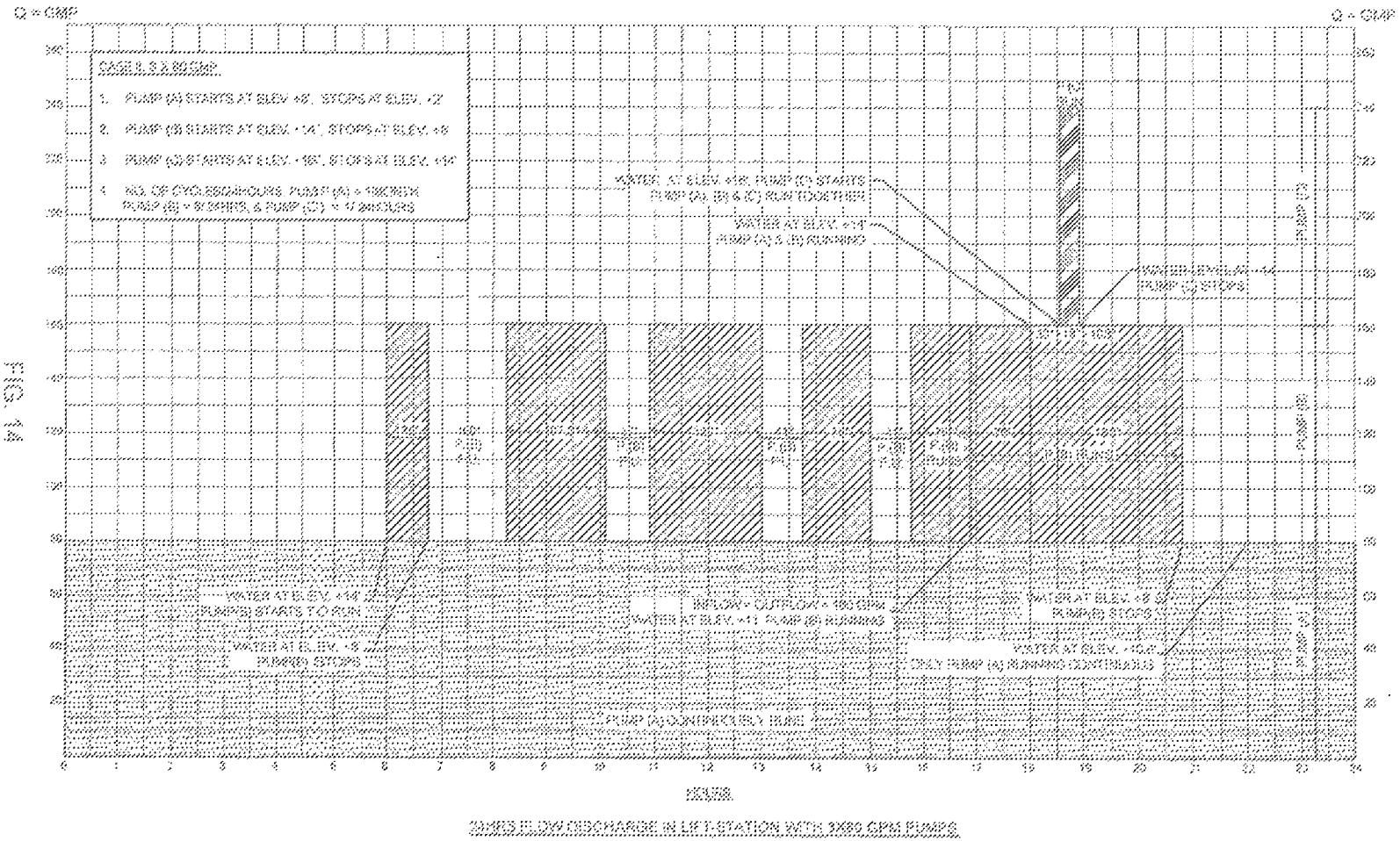

2—Flow Fluctuation in Force Main 108— a—In the traditional two pump system design 112, FIG. 8 represents the discharge flow 134 over time. It shows flow oscillation from zero and 160 GPM in 30 minute intervals. This flow 134 oscillation causes flow fluctuation in the down stream public main 304 and pressure fluctuation in the up stream main line 300 increasing opportunity for damage to pump impellers 114 and the variable frequency drives where they exist.

b—In the Green Pump Station Design 220, FIG. 14 represents the discharge flow 248 in the force main 230 over a 24 hour time period. As shown on the graph, the flow is continuous, moving a minimum of 80 GPM for Pump 1(A) 224. When the in-flow 202 is higher than 80 GPM, pump (B) 226 runs and the flow rate 248 to the force main 230 increases to 160 GPM. Therefore, the force main 230 flow fluctuates from 80 GPM to 160 GPM and since head loss is related to velocity squared, the head loss fluctuation to the up stream public main 302 is only 25% of the two pump system.

Figure 13:
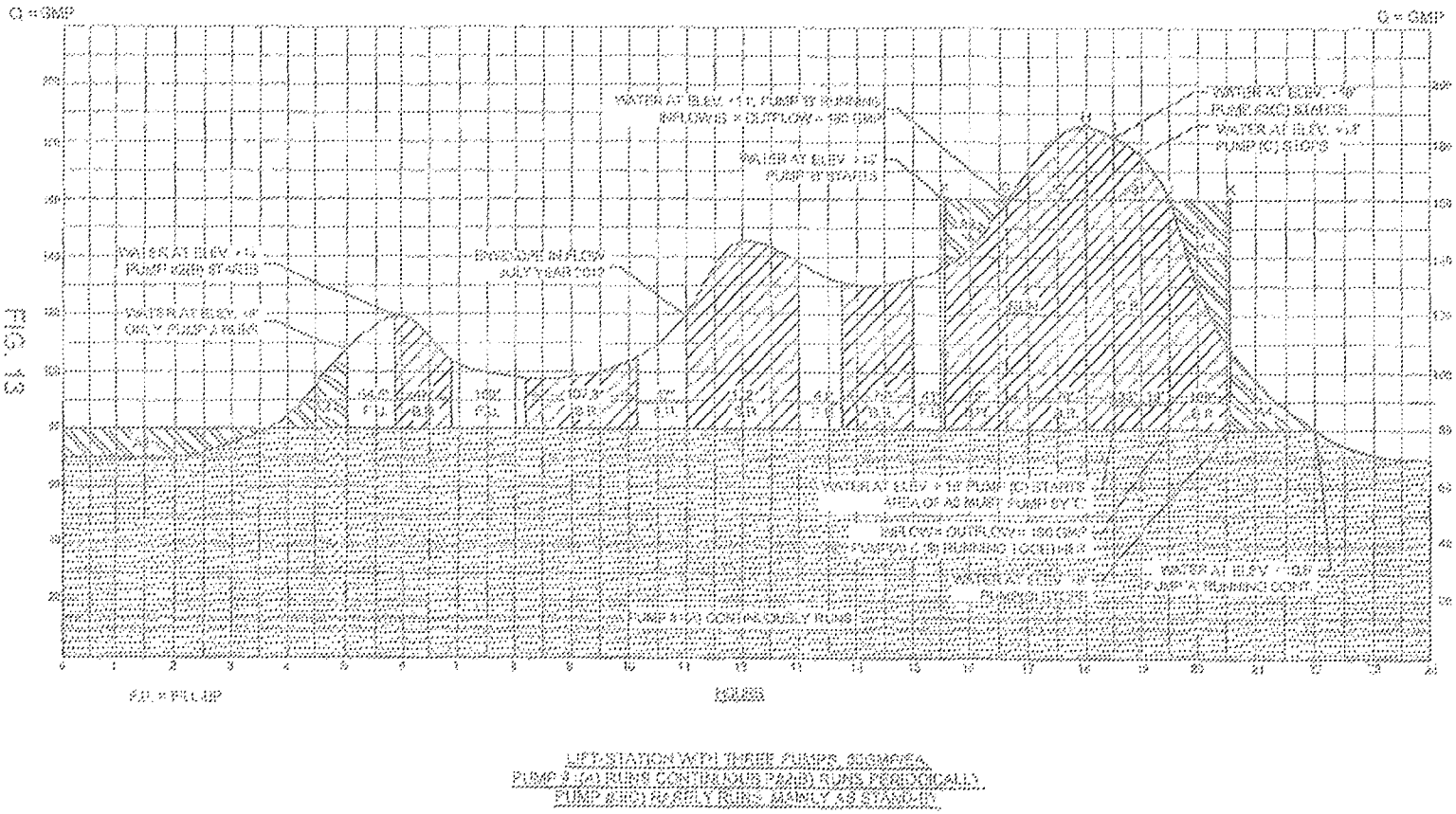

For comparison purposes, the force main 134 and 248 flow rates for the two pump 112 and the three pump 220 stations is presented in FIG. 13.

3—Pump Station Total Head Design—

DESIGN HEAD LOSS—The design head loss is the summation of static head (due to pump 104/106/224/226/228 and force main 108/230 elevation differences), friction loss in the run through the piping 340 and 342, dynamic loss due to the pipe turns and the back-up pressure. The design considers worst case scenarios for each of the four elements of the equation. The unit of measure is a foot of water.

4—Actual Head Loss—

Pump stations typically do not work under similar conditions. The process in determining the actual working conditions of a pump station requires several steps. First, the components of head loss must be examined part by part as:

A—Static Head— a—Discharge Static Head—The static head pressure at the discharge side of the pump is equal to the vertical elevation between the center line of the force main 108/230 and the pump impeller center line 114/254 in a foot of water. In any pump station, this discharge static head remains constant all the time.

b—Suction Static Head—Suction static head is the vertical distance between well water surface and a pump impeller center line 114/254. Suction static head varies all the time for different operating conditions as:

b—1 Suction Static Head in Two Pump Waste Water Pump Stations 112 b—1a Only Pump 1(A) 104 is Running

When in-flow stored in the wet well 102 elevates the water level to the start switch 126 of that pump, the pump 104 starts to run and discharges the water until the water level activates the stop switch 128. This means the fluctuation of the suction static head during the pump operation is equal to the vertical distance of start-stop 126-128 switches. For energy calculation purposes, it is a good assumption that the vertical distance between the impeller center line 114 and the mid point of the start-stop switches 126-128 be used as the average value for the suction static head for that pump 104.

b—1b Both Pumps 104 and 106 Running Together

In this case, the vertical distance of the mid point of the higher start-stop switches 130-132 to center of the impeller 114 will again be the average suction head for both pumps 104 and 106.

b—2 Suction Static Head in the Energy Saving Green Three Pump Waste Water Pump Station 220 b—2a Only Pump 1(A) 224 is running

In this station with three pumps 220, pump selection is determined in such a way that one pump 224 runs continuously because there is no start-stop switch for this pump and water continues to enter the well at the minimum flow rate calculated. Suction static head for Pump 1(A) 224 is always the vertical distance between the impeller center line 254 and the mid point of the start switch for Pump 2B 240 and will be used as the average value for the suction static head for that pump 224.

b—2b Pump 1(A) 224 and Pump 2(B) 226 Running Together

The vertical distance between the impeller center line 254 and the mid point of the start-stop switches 240-242 for Pump 2(B) will be the average suction static head for both pumps 224 and 226.

b—2c All Three Pumps 224, 226 and 228 Running Together

Under this condition, the vertical distance between the impeller center line 254 and the mid point of the higher start-stop set 244-246, which regulates Pump 3(C), will be the average suction static head for all three pumps 224, 226 and 228.

5—Numerical Values for Case I and Case II Pump Stations—

Discharge static head and suction static head for pump stations with the traditional two pump design (case 1) 112 and the Three Pump Energy Saving Green Pump Station Design (case II) 220 have been tabulated as (TABLE 3):

TABLE 3

| | PUMP#1 | PUMP#2 | PUMP#3 |
|---|---|---|---|
| | CASE I | | |
| TWO PUMP LIFT-STATION | | | |
| OPERATING CONDITIONS | ONLY PUMP#1 RUNS | BOTH PUMPS RUN | |
| DISCHARGE STATIC HEAD | 17.5 FEET | 17.5 FEET | |
| SUCTION STATIC HEAD | −5.5 FEET | −12.5 FEET FOR BOTH | |
| | CASE II | | |
| THREE PUMP LIFT-STATION | | | |
| OPERATING CONDITIONS | ONLY PUMP#1 RUNS | BOTH PUMPS 1 AND 2 RUN | ALL THREE PUMPS RUN |
| DISCHARGE STATIC HEAD | 16 FEET | 16 FEET | 16 FEET |
| SUCTION STATIC HEAD | −7.5 FEET | −10.5 FEET FOR BOTH PUMPS | −13.5 FEET FOR ALL THREE PUMPS |

6—Actual Friction Loss—

Design friction loss is based on design GPM of the force main 300/302 at the maximum GPM. However, most of the time the actual flow rate is less than the maximum GPM. The actual friction loss can be calculated by the following equation:

$$DH=f\times L/D\times V^2/2g \text{ ACTUAL FRICTION LOSS}$$

where

DH is the system head loss in a foot of water f—is the friction factor, dimensionless, and is related to the smoothness of the inside of the pipe.

L—is the hydraulic length of force main 108/230 from pump discharge 120/234 to the point of connection to the city main 304 in feet and it is the summation of all straight runs of the force main 108/230 plus straight runs equivalent to elbows, bends and off sets in feet.

D—is the diameter of the force main 108/230 pipe in feet

V—is the actual velocity corresponding to the actual flow rate in feet per second.

g—is the earth's gravitational acceleration equivalent to 32.2 ft/sec

In an operating pump station, the values of "f", "L", "D" and "g" are fixed and therefore the above equation can be rewritten as:

$$DH=K\times V^2 \text{ Friction Loss vs Velocity Squared}$$

7—Actual Dynamic Loss—

Dynamic head loss causes fluid to flow in the force main 108/230 and creates the actual velocity of "V". The actual dynamic head loss can be calculated by:

$$DH(\text{dynamic})=V^2/2g \text{ Dynamic Head Loss}$$

8—Numerical Values for Case I 112 and Case II 220—

Figure 9:
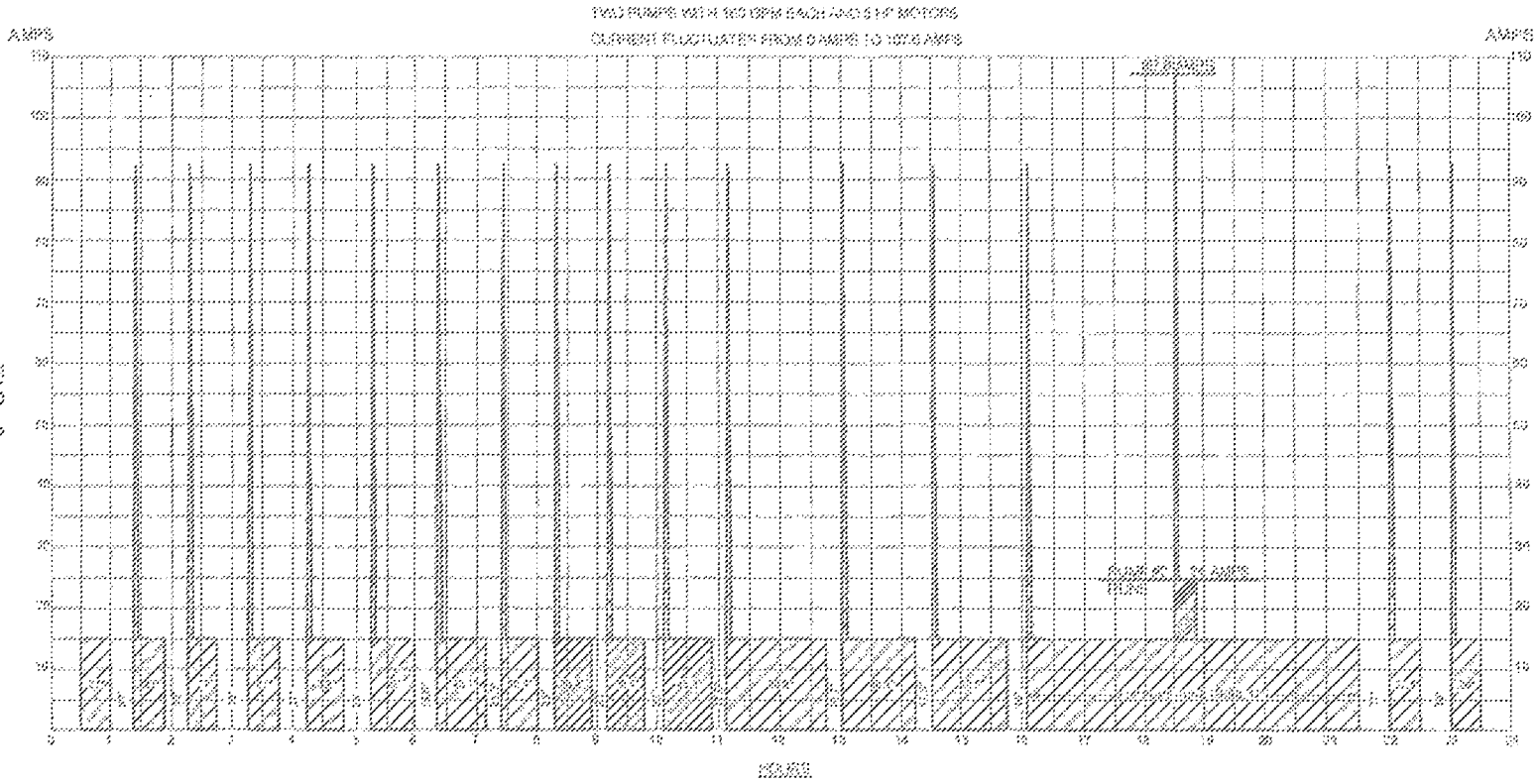
FIG. 9 Daily power draw from the utility company in CASE I study (Current Vs. Time for the two pumps in the 2 Pump Traditional Pump Station)
Figure 15:
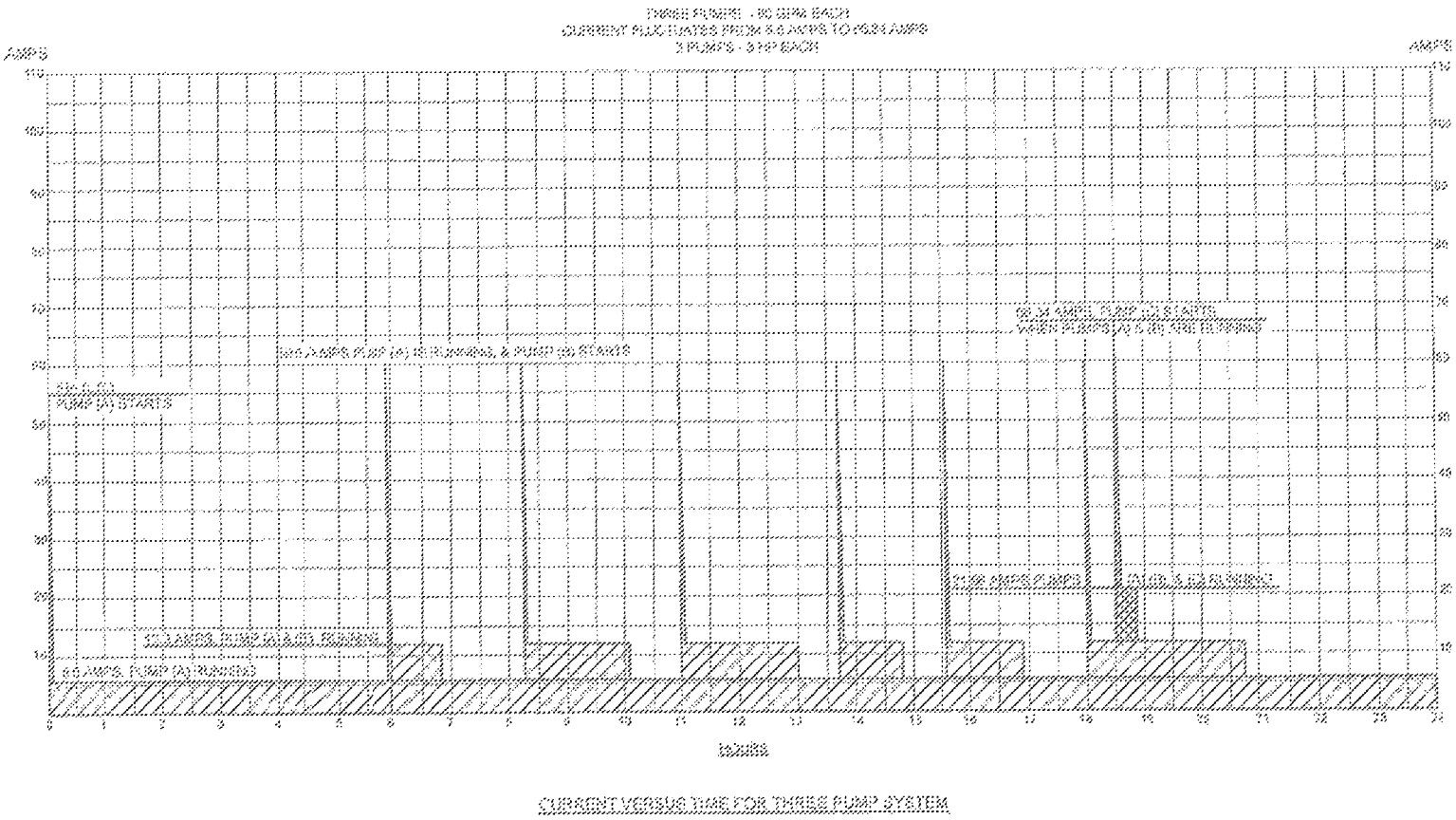
Figure 16:
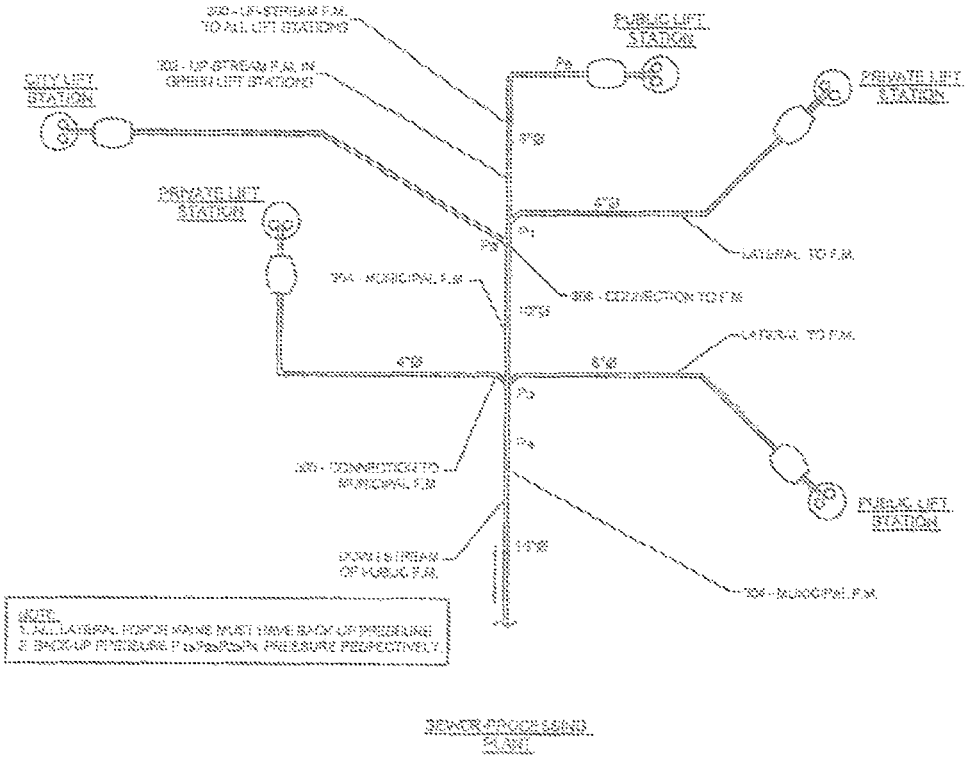
Figure 16:
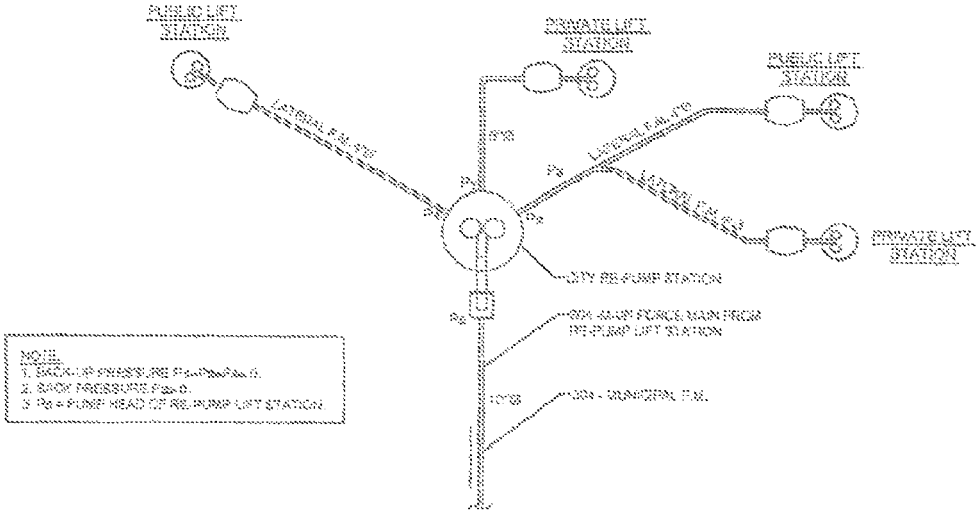

The actual friction loss and dynamic loss for a pump station with two pumps (case #1) 112 and three pumps (case #2) 220 have been evaluated under different operating conditions. Those values are given in TABLE 4. The power consumption for the two scenarios can be compared by FIG. 9 compared to FIG. 15.

TABLE 4

| DESCRIPTION | UNIT | PUMP#1 | PUMP#2 | PUMP#3 |
|---|---|---|---|---|
| | CASE I | | | |
| FORCE MAIN DIAMETER | INCHES | 4 | 4 | — |
| FORCE MAIN HYDRO LENGTH | FT | 1000 | 1000 | — |
| PUMP FLOW RATE | GPM | 160 | 160 | — |
| FORCE MAIN FLOW RATE | GPM | 160 | 320 | — |
| FLU1D VELOCITY "V" | FT/SEC | 4 | 8 | — |
| SQUARE OF VELOCITY "$V^2$" | $FT^2/SEC^2$ | 16 | 64 | — |
| FRICTION LOSS = 0.938 $V^2$ | FT | 15 | 60 | — |
| DYNAMIC LOSS = $V^2/2$ g | FT | 0.25 | 0.994 | |
| TOTAL FRICTION + DYNAMIC LOSS | FT | 15.25 | 60.994 | |
| | CASE II | | | |
| FORCE MAIN DIAMETER | INCHES | 4 | 4 | 4 |
| FORCE MAIN HYDRO LENGTH | FT | 1000 | 1000 | 1000 |
| PUMP FLOW RATE | GPM | 80 | 80 | 80 |
| FORCE MAIN FLOW RATE | GPM | 80 | 160 | 240 |
| FLUID VELOCITY "V" | FT/SEC | 2 | 4 | 6 |

TABLE 4-continued

| DESCRIPTION | UNIT | PUMP#1 | PUMP#2 | PUMP#3 |
|---|---|---|---|---|
| SQUARE OF VELOCITY "$V^2$" | $FT^2/SEC^2$ | 4 | 16 | 36 |
| FRICTION LOSS = 0.938 $V^2$ | FT | 3.75 | 15 | 33.75 |
| DYNAMIC LOSS = $V^2/2$ g | FT | 0.0625 | 0.25 | 0.56 |
| TOTAL FRICTION + DYNAMIC LOSS | FT | 3.81 | 15.25 | 34.31 |

9—Actual Back Pressure—

Most of the time, the actual back pressure at the connecting point of the force main 108/230 is less than the design back pressure. Actual operating back pressure can be measured at the end of the force main 108/230 then we can determine the average back pressure. If the force main 108/230 terminates into a man hole, then the back-up pressure is zero.

10 Actual Total Head Loss—

In topic numbers 3 to 9 above, all components of actual head loss were discussed. From these methods, the following total head loss is summarized in TABLE 5:

TABLE 5

| TWO PUMP LIFT-STATION | UNIT | PUMP#1 | PUMP#2 | PUMP#3 |
|---|---|---|---|---|
| CASE I | | | | |
| DISCHARGE HEAD LOSS | FT | +17.5 | +17.5 | — |
| SUCTION HEAD LOSS | FT | −5.5 | −12.5 | — |
| FRICTION & DYNAMIC LOSS | FT | +15.25 | +60.99 | — |
| NET TOTAL HEAD LOSS | FT | +27.25 | +65.99 | — |
| CASE II | | | | |
| DISCHARGE HEAD LOSS | FT | +16 | +16 | +16 |
| SUCTION HEAD LOSS | FT | −7.5 | −10.5 | −13.5 |
| FRICTION & DYNAMIC LOSS | FT | +3.81 | +15.25 | +34.31 |
| NET TOTAL HEAD LOSS | FT | +12.31 | +20.75 | +36.81 |

Note:

The inventor of this method would like the reader to pay special attention to the Net Total Head Loss of Case I and Case II. In Case I, all the fluid will be discharged with the total head loss of 27.25 ft. In Case II, 67.6% of fluid will be discharged with the total head loss of 12.31 ft. and 32.4% of fluid will be discharged with the total head loss of 20.75 ft.

11—Pump Station Energy Consumption—

In the operation of a pump station, energy will be used for different purposes. All energy consuming components will be discussed and their energy usage will be evaluated.

A—Initial Motor Start—

When the start switch 126/130/240/244 connects the power to a stationary pump, a considerable amount of energy is needed to bring the pump into normal operation. This is called "Starting Power". The starting power will be used in different ways as it will be discussed in the following:

A—Motor Magnetic Field—

In the absence of a magnetic field, the motor winding acts as pure ohmic resistance (ohmic resistance is defined as "a material's opposition to the flow of electric current; measured in ohms"). The resistance in this condition is minimal. Electrical current rushes into the winding at a rate of 7 to 8 times the full rated current of the motor. Most of this current creates heat which in turn elevates the winding's temperature. When the elevated, variable rushing current runs into the motor winding, it creates a changeable magnetic field. This magnetic field in turn induces electromagnetic power and current. It's current is against it's creator (the rushing current) so that it acts against the creator thereby reducing the rushing current to the rated current. When the pump stops, all the energy that had been used to establish the magnetic field will be dissipated and wasted entirely. The power consumed in the start up of a three phase motor can be calculated by:

$$KW/\text{START}-\sqrt{3}/2000*(I\text{LRA}+I\text{RA})*V*\text{COS}\ \Phi$$

where:

KW/START is power

ILRA is lock rated amps,

IRA is rated amps and

COS Φ is the power factor

The amount of time it takes for a motor to start varies. For this exercise, a start time of five seconds is a good assumption for calculating efficiency. In the starting time phase where the angle Φ=0 and COS Φ=1, using COS Φ=1 and a start time of five seconds, the equation of power and energy can be written as:

$$KW/\text{Start}=8.66\times10^{-4}(I\text{LRA}+I\text{RA})\times V$$ This is the equation of power $$KWH/\text{Start}=1.203\times10^{-6}(I\text{LRA}+I\text{RA})\times V$$ This is the equation of energy Where: ILRA is the lock rotor current or rushing current in amps IRA is motor rated amps V is voltage between two phases, in a three phase system, in volts B—Motor Rotor Kinematic (Kinetic) Energy:—

At the start of a motor, the stationary rotor needs to rotate and speed up to the required nominal RPM. A portion of the starting energy will be stored as rotor kinematic energy. When the motor stops, this stored energy will be totally dissipated and wasted by friction forces.

The motor rotor kinetic energy can be calculate by the following equation:

$$E=\tfrac{1}{2}IW^2$$

Where E is the stored kinetic energy in rotating rotor in 1 lb (one pound)×ft (the number of feet) and I is the mass momentum of the rotor in respect to the motor shaft center (in lbs [representing mass]+$ft^2$)

W is the angular velocity of rotor in "Radian/Second" in seconds operating in a 60 HZ power system W=376.8 Radian/Sec.

W is Omega

C—Impeller 114/254 Kinetic Energy—

When the pump starts, the stationary impeller 114/254 starts rotating until it reaches the nominal pump rpm. A rotating impeller 114/254 stores kinetic energy that it gets from "starting energy". Impeller 114/254 kinetic energy can be calculate by the following equation:

$$E=\tfrac{1}{2}IW^2$$

Where:

E is stored kinetic energy of the impeller 114/254 in lbs per foot

I is the mass momentum of the impeller 1141254 in respect to shaft center in lbs (mass)×$ft^2$ W is the angular velocity of the impeller 114/254 for direct connection of the pump and motor in a 60 HZ power system with 376.8 radian/sec. When the pump stops, all this kinetic energy will be dissipated by friction and wasted as heat.

D—Force Main 108/230 kinetic energy can be calculated as:—

This is the energy that is needed at each start to bring the entire body of the force main 108/230 water from stationary point to the velocity of V when the pump stops. This kinetic energy will be dissipated by shock waves along with the force main 108/230 pressure and will be wasted as heat. Force Main 108/230 Water Kinetic Energy can be calculated as:

$$E=\tfrac{1}{2}IW^2$$

E is the kinetic energy of water in the force main 108/230 in ft/lb ($2.655\times10^6$ ft/lb=kwh)

M is the mass of water in the force main 108/230.

For a force main 108/230 with diameter of D and a length of L, E will be (KINETIC ENERGY IN TERMS OF VELOCITY)

$$E=\tfrac{1}{2}\times f\P D^2/4\times L\times V^2$$

where D& L are the diameter and length of the force main 108/230 in feet and f is the specific mass of water and is 62.4 lb/ft for clean water V is the fluid velocity in force main 108/230 in ft/sec The above equation can be written as a function of GPM as $$E=3.154\times10^{-6}fL(\mathrm{GPM}/D)^2\text{(KINETIC ENERGY IN TERMS OF GALLONS PER MINUTE)}$$

Where GPM is the flow rate in gallons per minute and 1 cubic foot of water=7.49 gallons of water. All items from "A" to "D" above are the energy demands just for the start of the pump. When the pump stops, all this energy will be dissipated to heat. In the Energy Saving Green Waste Water Pump Station Design, the energy demands for the start of the pump 224/, 226 AND 228 are limited as much as possible.

Pumping Energy—

In a pump station with total head loss of "H" (in ft) and a force main 108/230 flow rate of "GPM", the theoretical energy need for water lift can be obtained from $$W_{HP}=(\mathrm{GPM}\times H\times \mathrm{SG})/3960$$

Where:

$W_{HP}$ is the water horse power, the theoretical power needed to lift the water and deliver it through the force main 108/230.

GPM is the pump station force main 108/230 flow rate in gallons per minute

H is the total head loss in feet

SG is the specific gravity in respect to water (ST of fluid is close to 1.0)

The pump lifts the water, the pump has the efficiency and the break horse power on the pump shaft is higher than the water horse power. If the pump efficiency is $E_P$ where "$_P$" is the index of the pump (pump efficiency), then the pump shaft break horsepower is:

$$BHP=(\mathrm{GPM}\times H\times \mathrm{SG})/3960\times E_P \text{ PUMP SHAFT BREAK HORSEPOWER}$$

The pump runs by an electric motor. Part of the power that the motor receives converts to heat by winding resistance, escaped magnetic field and eddy current. Therefore, the power output of the motor is less than the input power. The ration of motor power output to the supplying power company's network power input is called motor efficiency—symbolized as $E_M$.

The calculation to determine the amount of power needed for the supplying power company to run the motor is calculated as follows:

$$BHP=(\mathrm{GPM}\times H\times \mathrm{SG})/3960\times E_P\times E_M$$

Where:

BHP is the power from the supplying power company $E_P$ is pump efficiency and $E_M$ is motor efficiency Pump Station Maintenance—

In pump stations, pumps have moving parts that are subject to wear and tear. To insure safe operation of pump stations, a routine maintenance program should be adopted and followed regularly. The two primary types of maintenance activities for pump stations are Preventative Maintenance and Emergency Maintenance.

Preventative Maintenance is routine, scheduled maintenance providing for:

A) visual inspection of the well for any concrete cracks, railing and metal corrosion in need of repair B) removal of floating debris such as fibrous leave, dead animals, excessive grease ball, etc.

C) operation of submerged pumps, running current and voltage during all phases of operation with results compared to the manufacturer's rated data D) cleaning and testing of all float switches E) inspection of the electrical panel for tripped breaker or burned out wiring Emergency Maintenance occurs due to the unexpected failure of a pump, motor, switch, control or a power interruption. Pump manufacturer statistical data indicates that over 90% of unexpected pump stops are due to burned out motors. The motor of a submersible pump burns out for the following reasons, in listed the order of frequency of occurrences:

A) Pump Short Cycling—Pump short cycling results from pumps starting and stopping in a short amount of time. The period of time is short enough that there is not sufficient time for the generated heat of the previous start to be dissipated. Heat from the start will build up and the temperature of the winding will increase to the point where it damages the winding wire insulator and finally burning out the motor.

B) Excessive Resistance Torque—During the starting stage of the pump, the pump impeller and pump motor have not reached their nominal speed. During this time, foreign objects like fibrous leaves and small animals (mouse, snake, etc) could be sucked into the impeller causing the impeller to stop. When a sudden stop occurs, the current in a running motor increases by 800% and converts to heat which in turn will melt down the winding.

In a running pump, the kinetic energy stored in the impeller, motor rotor and shaft is enough to overcome the resistive torque of these objects and the sucked in object, allowing the impeller to grind down the object before the pump stops.

C) Loss of a Phase—

1) In a three phase motor, the rotating torque that rotates the motor rotor comes from an elector-magnetic force created in the squirrel cage of the rotor. Only a rotating magnetic field resulting front three phase power can generate a rotating torque. If power coming to the three phase motor suddenly is lost, then:

a—the three phase motor continues to run but at a power rate of 66% of that of the full three phase.

b—the three phase motor receives two phase power and the motor can not continue to run for a long period of time due to the absence of the rotating magnetic field causing the motor to eventually burn out 2) The pump station panel becomes two phase—The incoming utility system power is three phase but the pump station panel has a missing leg. This often happens when the pump station has a fusible disconnect as it's main. When, for some reason, one fuse burns out, the power in the pump station becomes two phase and the pump will burn out.

3) Lightening could cause Loss of the Phase—When an overhead line with a set of three banks of a single phase transformer is the source of the power supply to the pump station, then any lightening to one line or to one transformer could be the cause at a missing phase.

Prevention from Loosing a Phase

To avoid the supply power to the pump station becoming two plisse, the following should be considered:

1—The three phase circuit breaker should be used as the main beaker instead of a fusible disconnect.

2—Protect the distribution panel from the loss of any phase through a phase loss relay acting on the main breaker 3—Install a set of three lightening arresters on high sides of the utility transformers D) Mechanical Seal Failure—In a pump, a mechanical seas is between the motor and the pump preventing water from entering the motor housing. Mechanical seal failure is the third most common cause of pump failure. The material that the mechanical seal is made of is damaged by heat and friction forces resulting in the seal loosing it's elasticity. The result of a mechanical seal failure is motor burn out.

E) Other Considerations—Float switches are subject to corrosion and failure due to the harsh environmental condition in the wet-well. The proper operation of each must be checked periodically. Another potential pump failure component is the pump power contactor. Pump short cycling is the main reason for wear and tear on a power contactor. For this reason, the life of the power contactor is determined by the number of short cycles the pump endures.

The Energy Saving Green Pump Station Design Extends Pump Life and Reduces Maintenance Costs From the information provided above, it is clear that a two pump-station design results in short cycling and impeller related problems increasing maintenance requirements and reducing the life of the pumps.

In the Energy Saving Green Waste Water Pump Station Design, one pump is always running and preventing many of the failures identified above. The MAINTENANCE section of Table 11 provides comparative data between a typical Two Pump-Station and the Energy Saving Green Waste Water Pump Station Design.

TABLE 6

| | | TWO PUMPS/160 GPM | | | THREE PUMPS/80 GPM EACH | | | |
|---|---|---|---|---|---|---|---|---|
| DESCRIPTION | UNIT | PUMP#1 | PUMP#2 | TOTAL | PUMP#1 | PUMP#2 | PUMP#3 | TOTAL |
| WET WELL DIAMETER | FT | 8 | 8 | 8 | 8 | 8 | 8 | 8 |
| WET WELL DEPTH | FT | 20 | 20 | 20 | 18 | 18 | 18 | 18 |
| WALL THICKNESS | INCHES | 8 | 8 | 8 | 8 | 8 | 8 | 8 |
| VOLUME OF ONE FT HIGHT | $FT^3$ | 50.24 | 50.24 | 50.24 | 50.24 | 50.24 | 50.24 | 50.24 |
| VOLUME OF 6 FT HIGHT IN GALLONS (1 $FT^3$ = 7.48 GALS) | GALLONS | 2255 | 2255 | 2255 | 2255 | 2255 | 2255 | 2255 |
| TIME CYCLING, START TO STOP, INFLOW = 0 | MINUTES | 14 | 7 | — | 28 | 14 | 9 | — |
| PUMP CENTER ELEVATION TO GROUND | FT | −19.5 | −19.5 | −19.5 | −17.5 | −17.5 | −17.5 | −17.5 |
| PUMP CENTER ELEVATION TO FORCE MAIN (PUMP DISCHARGE HEAD) | FT | +17.5 | +17.5 | +17.5 | +15.5 | +15.5 | +15.5 | +15.5 |
| WEIGHT OF WET WELL (WALL 8", BOTTOM SLAB 1 FT, TOP SLAB 10") REPRESENTING DOWN LIFT | LBS | — | — | 75,870 | — | — | — | 70,395 |
| THE BUOYANT FORCE OF WELL REPRESENTING UP LIFT | LBS | — | — | 92,247 | — | — | — | 85,346 |
| CONCRETE AS WEIGHT TO OVER COME BOUYANCE | $YARDS^3$ | — | — | 6.92 | — | — | — | 6.32 |
| FLOW IN FORCE MAIN | GPM | 160 | 320 | 320 | 80 | 160 | 240 | 240 |
| DIAMETER OF FORCE MAIN | INCHES | 4 | 4 | 4 | 4 | 4 | 4 | 4 |

TABLE 7

| | | | TWO PUMPS/160 GPM | | | THREE PUMPS/80 GPM EACH | | | |
|---|---|---|---|---|---|---|---|---|---|
| ITEM | DESCRIPTION | UNIT | PUMP#1 | PUMP#2 | TOTAL | PUMP#1 | PUMP#2 | PUMP#3 | TOTAL |
| FORCE MAIN | VELOCITY OF FLUID IN PIPE (FPS) | FT/SEC | 4 | 8 | 8 | 2 × 10−2 | 4 | 6 | 6 |
| | PRESSURE LOSS ΔP/100 FT OF PIPE DUCTILE IRON USING GRAPH | FT/100 FT | 1.5 | 5.5 | 5.5 | 0.4 | 1.5 | 3.2 | 3.2 |
| | VOLUME OF WATER IN 1000 FT OF 4" FORCE MAIN | $FT^3$ | 87.2 | 87.2 | 87.2 | 87.2 | 87.2 | 87.2 | 87.2 |
| | MASS OF WATER IN 1000 FT OF FORCE MAIN (ƒ = 62.4 $LB/FT^3$) | LBS | 5443 | 5443 | 5443 | 5443 | 5443 | 5443 | 5443 |
| | ENERGY TERM OF VELOCITY = $V^2$/2 g WHERE g = 32.2 $FT/SEC^2$ = GRAVITY ACCELERATION | FT | 0.248 | 0.994 | 0.994 | 0.062 | 0.248 | 0.559 | 0.559 |
| | L/D = DIMENSIONLESS PARAMETER EFFECTIVE IN HEAD LOSS | NONE | 3000 | 3000 | 3000 | 3000 | 3000 | 3000 | 3000 |
| | ƒ = FRICTION FACTOR, DIMENSIONLESS DEPENDING ON INNER PIPE SURFACE | NONE | $2 \times 10^{-2}$ | $2 \times 10^{-2}$ | $2 \times 10^{-2}$ | $2 \times 10^{-2}$ | $2 \times 10^{-2}$ | $2 \times 10^{-2}$ | $2 \times 10^{-2}$ |
| | hf= f × L/D × $V^2$/2 g HEAD LOSS IN A FT OF WATER | FT | 14.9 | 59.9 | 59.9 | 3.72 | 14.9 | 33.54 | 33.54 |
| | hs SUCTION STATIC PRESSURE AVERAGE (IE. WATER LEVEL TO IMPELLER CENTER) | FT | 5.5 | 12.5 | 0 | 7.5 | 10.5 | 13.5 | 0 |
| | hd DISCHARGE STATIC PRESSURE (IE. AVE VERTICAL DISTANCE FROM FORCE MAIN TO IMPELLER CENTER) | FT | 17.5 | 17.5 | 0 | 15.5 | 15.5 | 15.5 | 0 |
| | hb BACK-UP STATIC PRESSURE AT END OF FORCE MAIN CONNECTED TO ANOTHER FORCE MAIN | FT | 30 | 30 | 30 | 30 | 30 | 30 | 30 |
| | Hv = hf + hv = V2/2 g × (f × L/D + 1) TOTAL HEAD LOSS RELATING TO VELOCITY | FT | 15.15 | 60.894 | 60.894 | 3.78 | 15.15 | 34.1 | 34.1 |
| | Hcal = hb + Hv + hd − hs TOTAL HEAD LOSS CALCULATED FOR FORCE MAIN | FT | 57.15 | 95.894 | 95.894 | 41.78 | 50.15 | 66.1 | 66.1 |
| | TOTAL OPERATING HEAD OF PUMP USED FOR WHP CALCULATION | FT | 57.15 | 60 | 60 | 41.78 | 48 | 60 | 60 |

TABLE 8

| | | TWO PUMPS/160 GPM | | | THREE PUMPS/80 GM EACH | | | |
|---|---|---|---|---|---|---|---|---|
| DESCRIPTION | UNIT | PUMP#1 | PUMP#2 | TOTAL | PUMP#1 | PUMP#2 | PUMP#3 | TOTAL |
| PUMP DESIGN CAPACITY | GPM | 160 | 160 | 320 | 80 | 80 | 80 | 240 |
| PUMP TOTAL HEAD DESIGN | FT | 60 | 60 | 60 | 60 | 60 | 60 | 60 |
| PUMP IMPELLER DIAMETER MINIMUM TO MAXIMUM | MM | 114 TO 126 | 114 TO 126 | — | 114 TO 126 | 114 TO 126 | 114 TO 126 | — |
| PUMP TRIMMED IMPELLER DIAMETER | MM | 122 | 122 | — | 120 | 120 | 120 | — |
| MOTOR HORSE POWER | HP | 5 | 5 | 10 | 3 | 3 | 3 | 9 |
| BREAK HORSE POWER | HP | 4.7 | 4.7 | 9.4 | 2.7 | 2.7 | 2.7 | 8.1 |
| PUMP EFFICIENCY MAX AT GPM & HEAD | % | 57% AT 160 GPM/60' HEAD | 57% AT 160 GPM/60' HEAD | — | 54% AT 90 GPM/55' HEAD | 54% AT 90 GPM/55' HEAD | 54% AT 90 GPM/55' HEAD | — |
| PUMP EFFICIENCY AT DESIGN CONDITION FOR CASE I & CASE II | % | 55.00% | 10.00% | 53.72% | 51.00% | 52.50% | 52.00% | 51.44% |
| MOTOR ROTATING SPEED | RPM | 3600 | 3600 | — | 3600 | 3600 | 3600 | — |
| VOLTAGE = 3 PHASE | VOLTS | 208 | 208 | 208 | 208 | 208 | 208 | 208 |
| NOMINAL RATED CURRENT | AMPS | 14.6 | 14.6 | — | 8.8 | 8.8 | 8.8 | — |
| LOCK ROTOR CURRENT | AMPS | 93 | 93 | — | 54 | 54 | 54 | — |
| NOMINAL HORSEPOWER | HP | 5 | 5 | 10 | 3 | 3 | 3 | 9 |

TABLE 9

| | | | TWO PUMPS/160 GPM | | | THREE PUMPS/80 GPM EACH | | | |
|---|---|---|---|---|---|---|---|---|---|
| ITEM | DESCRIPTION | UNIT | PUMP#1 | PUMP#2 | TOTAL | PUMP#1 | PUMP#2 | PUMP#3 | TOTAL |
| MOTOR | OUTPUT OF MOTOR | KW | 3.7 | 3.7 | 7.4 | 2.2 | 2.2 | 2.2 | 6.6 |
| | MOTOR EFFICIENCY | % | 78.8% | 78.8% | 78.8% | 78.8% | 78.7% | 79.2% | 78.8% |
| | | | 79.2% | 79.2% | 79.2% | 79.2% | 78.5% | 78.5% | 78.5% |
| | PUMP FACTOR = COSφ, | AS | 89% | 89% | 89% | 88% | 88% | 88% | 88% |
| | DIMENSIONLESS | DECIMAL | 87% | 87% | 87% | 83% | 83% | 83% | 83% |
| | MAXIMUM CURRENT FROM NETWORK | AMPS | 93 | 107.6 | 186 | 54 | 59.6 | 66.33 | 66.33 |
| | PUMPING CURRENT FROM NETWORK FOR CASE I AND CASE II | AMPS | 14.96 | 9.073 | 24.03 | 5.59 | 6.74 | 9.61 | 21.95 |
| | MAXIMUM DEMAND LOAD FROM NETWORK | AMPS | — | — | 186 | — | — | — | 66.33 |
| | WEIGHT OF SUBMERSIBLE MOTOR PUMP | LBS | 142 | 142 | — | 120 | 120 | 120 | — |
| OPERATION | NUMBER OF CYCLES/24 HRS | — | 17 | 1 | 18 | 0.4 | 6 | 1 | 7.4 |
| | NUMBER OF CYCLES/YR | — | 6205 | 365 | 6570 | 12 | 2190 | 365 | 2567 |
| | MINUTES OF OPERATION/DAY | MINUTES | 1029 | 30 | — | 1410 | 586 | 19 | — |
| | HOURS OF OPERATION/YR = 6.083 × MINUTES PER DAY | HR | 6259 | 183 | — | 8577 | 3565 | 116.00 | — |
| | WHP = GPM × H × SG/3960 WATER HP SG = 1.10 OF WATER | HP | 254 | 1.33 | — | 0.927 | 1.067 | 1.330 | — |
| | OPERATING EFFICIENCY FOR EACH PUMP | % | 57% | 40% | 56.57% | 53% | 53% | 53% | 53% |

TABLE 10

| | | | TWO PUMPS/160 GPM | | | THREE PUMPS/80 GPM EACH | | | |
|---|---|---|---|---|---|---|---|---|---|
| ITEM | DESCRIPTION | UNIT | PUMP#1 | PUMP#2 | TOTAL | PUMP#1 | PUMP#2 | PUMP#3 | TOTAL |
| OPERATION | BHP = WATER HP/MP OF PUMP THIS IS BREAK HP | HP | 4.455 | 3.170 | — | 1.749 | 2.010 | 2.550 | — |
| | INPUT POWER = BHP/MP = BHP/0.786 | HP | 5.67 | 4.04 | — | 2.22 | 2.56 | 3.19 | — |
| | INPUT POWER = BHP × 746/MP × 1000 = 0.949 BHP (KW) | KW | 4.230 | 3.000 | — | 1.656 | 1.910 | 2.380 | — |
| | KW/START = $8.66 \times 10^{-4}$ (ILRA + IRA) × V START POWER (V = 248 V) IN KW | KW/START | 19.38 | 19.38 | — | 11.31 | 11.31 | 11.31 | — |
| | KWH/START = $1.203 \times 10^{-6}$ (ILRA + IRA) × V THIS IS THE ENERGY OF 5 SECOND START IN KWH | KWH/START | $2.7 \times 10^{-2}$ | $2.7 \times 10^{-2}$ | — | $1.57 \times 10^{-2}$ | $1.57 \times 10^{-2}$ | $1.57 \times 10^{-2}$ | — |
| | KINETIC ENERGY = $3.154 \times 10^{-6}$ P × L × $(GPM/D)^2$ WITH FORCE MAIN WATER P = 1.12 × WATER PRESSURE = 68.6 LBS/$FT^3$ * | FT·LB/START | 49850 | 49850 | — | 12463 | 12463 | 12463 | — |
| OPERATION | KINETIC ENERGY FOR FORCE MAIN WATER IN KWH = FT·LB/ $2.655 \times 10^6$ | KWH/START | $1.88 \times 10^{-2}$ | $1.88 \times 10^{-2}$ | — | $4.69 \times 10^{-3}$ | $4.69 \times 10^{-3}$ | $4.69 \times 10^{-3}$ | — |
| | ENERGY FOR THE PUMP & FORCE MAIN WATER = KINETIC ENERGY/ZP MM → 5% = 2.0 × KINETIC ENERGY FM WATER | KWH/START | 0.376 | 0.376 | — | 0.094 | 0.094 | 0.094 | — |
| | TOTAL KWH/START = KWH FOR MOTOR + KWH FOR KIN.FM | KWH/START | 0.403 | 0.403 | — | 0.110 | 0.110 | 0.110 | — |
| | NUMBER OF CYCLES/YEAR | CYCLES | 6205 | 365 | — | 12 | 2190 | 365 | — |
| | KWH OF START/YR = KWH/START × NUMBER OF CYCLES | KWH/YR | 2500 | 147.1 | 2647 | 1.32 | 241 | 40.15 | 282.5 |
| | HOURS OF OPERATION/YR | HRS/YR | 6258 | 182.5 | — | 8577.5 | 3567 | 115.6 | — |
| | PUMPING KW HRS/YR = KW POWER INPUT × HRS/YR | KWH/YR | 26471 | 548 | 27019 | 14204 | 6813 | 275 | 21292 |

* GPM OF EACH PUMP CAUSES THE CHANGE IN WATER MOMENTUM

TABLE 11

| | | | TWO PUMPS/160 GPM | | | THREE PUMPS/80 GPM EACH | | | |
|---|---|---|---|---|---|---|---|---|---|
| ITEM | DESCRIPTION | UNIT | PUMP#1 | PUMP#2 | TOTAL | PUMP#1 | PUMP#2 | PUMP#3 | TOTAL |
| OPERATION | PUMP KWH/YR NORMALIZED TO $M_P$ CASE II BY 57/53 = 1.0755 | KWH/YR | 28469 | 589 | 29058 | 14204 | 6813 | 275 | 21292 |
| | ELECTRIC ENERGY LOSS IN FEEDING CIRCUIT WHERE E = $RI^2T$ | KWH/YR | — | — | 47.6 | — | — | — | 33 |
| | TOTAL KWH FROM POWER NETWORK WHERE ET = $E_{PUMING} + E_{STAR} + E_{NETWORK}$ | KWH/YR | 30969 | 736 | 31705 | 14205.3 | 7054 | 315.15 | 21574.45 |
| | KWG/YR OF CASE I AND CASE II IN RELATION TO CASE I | % | — | — | 100.00% | — | — | — | 68.05% |
| | ENERGY REDUCTION/YR BY USING 3 PUMP GREEN DESIGN WHEN CASE I IS A GOOD DESIGN | % ↘ | — | — | — | — | — | — | 31.95% |
| | CORRECTION OF 50% PUMP OVER SIZED (IN EXI LIFTS) VS GOOD TWO PUMP SYSTEM, KWH/START INCREASES BY 50% | KWH/ START/ YR | 1250 | 73.5 | 1323.5 | — | — | — | — |
| | ANNUAL ENERGY CONSUMPTION | KWH/YR | 32219 | 809.5 | 33028.5 | 14205.3 | 7054 | 315.15 | 21574.45 |
| | ENERGY REDUCTION/YR BY USING 3 PUMP GREEN DESIGN | % ↘ | — | — | — | — | — | — | 34.68% |
| MAINTENANCE | ACTUAL NUMBER OF CYCLING/YR (DUE TO ROTATING PUMPS, STARTS ARE EVEN) | STARTS/ YR | 3285 | 3285 | 6570 | 856 | 856 | 856 | 2568 |
| | NUMBER OF STARTS IN THE LIFE OF A PUMP | STARTS | 20000 | 20000 | — | 20000 | 20000 | 20000 | — |
| | EXPECTED LIFE OF PUPUMP BASED IN 20,000 STARTS | YRS | 6.09 | 6.09 | — | 23.36 | 23.36 | 23.36 | — |
| | MAINTENANCE COST OF A PUMP OVER 20 YRS | $ U.S. | $22,293 | $22,293 | $44,586 | $4,985 | $4,985 | $4,985 | $14,955 |
| | 20 YR MAINTENANCE REDUCTION | % | — | — | — | — | — | — | 66% |

35

TABLE 12

| | | | TWO PUMPS/160 GPM | | | THREE PUMPS/80 GPM EACH | | | |
|---|---|---|---|---|---|---|---|---|---|
| ITEM | DESCRIPTION | UNIT | PUMP#1 | PUMP#2 | TOTAL | PUMP#1 | PUMP#2 | PUMP#3 | TOTAL |
| RUNNING COST | COST OF POWER FOR ONE YR BASED ON 2011 U.S. $ | CENTS/ KWH | 12 | 12 | 12 | 12 | 12 | 12 | 12 |
| | ESTIMATED AVERAGE COST OF POWER OVER 20 YRS | CENTS/ KWH | 23.3 | 23.30% | 23.3 | 23.3 | 23.3 | 23.3 | 23.3 |
| | TOTAL POWER TO RUN PUMPS OVER 20 YRS | KWH/20 YRS | 317526 | 317526 | 635052 | 144050 | 144050 | 144050 | 432150 |
| | COST OF POWER TO RUN PUMPS OVER 20 YRS | $ U.S. | $73,984 | $73,984 | $147,967 | $33,564 | $33,564 | $33,564 | $100,691 |
| | TOTAL COST OF INITIAL INSTALLATION IN U.S. $ | $ U.S. | | | $75,500 | | | | $85,000 |
| | TOTAL MAINTENANCE COST OVER 20 YRS | $ U.S. | $22,293 | $22,293 | $44,586 | $4,985 | $4,985 | $4,985 | $14,955 |
| | TOTAL COST OF LIFT STATION OVER 20 YRS | $ U.S. | | | $268,053 | | | | $200,646 |
| | COST COMPARISON | % | — | — | 100.00% | — | — | — | 74.85% |
| CRUDE OIL IMPORTS | BOE (BARRELS OF OIL EQUIVALENT) ENERGY RELEASED BY ONE BARREL OF OIL IN KWH | KWH/ BARREL | 1700 | 1700 | 1700 | 1700 | 1700 | 1700 | 1700 |
| | LIFT STATION 20 YR ENERGY CONSUMPTION IN CRUDE | BARRELS | 186.78 | 186.78 | 373.56 | 84.74 | 84.74 | 84.74 | 254.21 |
| | 20 YR CRUDE OIL REDUCTION BY USING GREEN DESIGN | BARRELS | — | — | — | — | — | — | 119.35 |
| | 20 YR ENERGY CONSUMPTION IN TONS OF OIL WHERE 1 TON = 7.4 BARRELS | TONS | 25.24 | 25.24 | 50.48 | 11.45 | 11.45 | 11.45 | 34.35 |
| | CRUDE OIL CONSUMPTION TO GENERATE ELECTRIC POWER WHERE THE MOST EFFICIENT THERMAL PLANT PRODUCES 30% | BARRELS | 622.6 | 622.6 | 1245.2 | 282.5 | 282.5 | 282.5 | 847.4 |

TABLE 12-continued

| ITEM | DESCRIPTION | UNIT | TWO PUMPS/160 GPM | | | THREE PUMPS/80 GPM EACH | | | |
|---|---|---|---|---|---|---|---|---|---|
| | | | PUMP#1 | PUMP#2 | TOTAL | PUMP#1 | PUMP#2 | PUMP#3 | TOTAL |
| | USEFUL ENERGY FROM THE ENERGY CONSUMED | | | | | | | | |
| | SAVINGS IN CRUDE IMPORTS | BARRELS | — | — | — | 150.00 | 150.00 | 150.00 | 450.10 |
| | SAVINGS IN CRUDE IMPORTS FOR 1 HP OF A PUMP USED IN THE TWO PUMP SYSTEM | BARRELS | — | — | — | 15 | 15 | 15 | 45 |
| | ESTIMATED AVERAGE PRICE OF ONE BARREL OF CRUDE OIL OVER 20 YRS | $ U.S. | $118 | $118 | $118 | $118 | $118 | $118 | $118 |

The invention claimed is:

1. A method of operating a plurality of N identical station pumps in a wastewater lift well whereby the horse power and pumping capacity of the pumps will be optimized based on the minimum inflow of fluid into the lift station and the maximum force main head, the method comprising:

running a first pump continuously as the base pump until the inflow to said well exceeds the capacity of the running base pump at which time said inflow will store in the well and the water level will rise to a predetermined elevation and activate a starting float switch, starting the operation of a second pump, running both pumps until the water level falls down to an elevation of a stop float switch for the second pump, turning off the second pump, in emergency conditions when the inflow rate is greater than the combined pumping capacity of both the first pump and the second pump, the water level will rise in the well up to the elevation of a start switch of a third pump, starting operation of the third pump so that all three pumps are running, a pump station set is assigned such that each of the N station pumps is successively numbered 1 to N; and the pumps being controlled by a sequence controller for controlling the order of operation of the station pumps, the sequence controller including a power circuit associated with each of the station pumps, a timer having a timer total period and an indicator arm; and N control circuits each comprising a timer contactor, said start float switch, said stop float switches, an overflow float switch and auxiliary relays;

said N timer contactors being arranged to contact said indicator arm and dividing said timer total period into N equal operating periods equal to said timer total period/N;

said sequence controller operating the station pumps by performing the following steps:

Step 1 assigning a variable PrimaryPump=1 and a variable Operating Period=1; and then beginning operation of the timer;

Step 2 assigning a pump station sequence with the primary pump being the station pump of said pump station set equal to PrimaryPump, a secondary pump being the station pump of said pump station set equal to PrimaryPump+1; with the successive pumps of the pump station sequence being numbered in order following the secondary pump, such that when ordering the pumps when station pump N is reached the next pump in the pump station sequence will be station pump number 1; the sequencing continuing until all N station pumps have been assigned to the pump station sequence, with the Nth pump in the sequence being assigned as the backup/emergency pump;

Step 3 operating the pumps as assigned in the pump station sequence in response to the water level in the well and the activation and deactivation of the start and stop float switches during said operating period until the timer indicator arm contacts the next of the N timer contactors;

Step 4 assigning PrimaryPump=PrimaryPump+1, and Operating Period−OperatingPeriod+1; if OperatingPeriod is greater than N then assigning PrimaryPump=1 and OperatingPeriod=1; and Step 5 returning to step 3, said timer having a face, and the face of said timer having 30 divisions each representing a day and said indicator arm rotates clockwise whereby one full rotation of the indicator arm occurs over a 30 day period.

* * * * *